US006002246A

United States Patent [19]

Gohkon et al.

[11] Patent Number: 6,002,246

[45] Date of Patent: Dec. 14, 1999

[54] FLYBACK TRANSFORMER

[75] Inventors: Kiyohiko Gohkon, Kanagawa; Teruaki Sato; Mitsuhiro Kanno, both of Iwate; Akira Kikuchi, Kanagawa, all of Japan

[73] Assignee: Hitachi Media Electronics Co., Ltd., Iwate, Japan

[21] Appl. No.: 09/154,700

[22] Filed: Sep. 17, 1998

[30] Foreign Application Priority Data

Dec. 12, 1997 [JP] Japan ..... 9-343235

[51] Int. Cl.[6] ..... H01F 40/04; H01F 15/10; H01F 27/28

[52] U.S. Cl. ..... 323/359; 336/192; 336/195

[58] Field of Search ..... 323/359; 336/192, 336/195, 178, 198, 185, 208

[56] References Cited

U.S. PATENT DOCUMENTS

| | | | |
|---|---|---|---|
| 3,904,928 | 9/1975 | Sawada et al. | 315/410 |
| 4,183,002 | 1/1980 | Haslau | 336/192 |
| 4,204,263 | 5/1980 | Onoue | 363/68 |
| 4,334,206 | 6/1982 | Nakamura | 336/96 |
| 4,390,819 | 6/1983 | Babcock et al. | 315/411 |
| 4,499,522 | 2/1985 | Nakamura | 361/836 |
| 4,623,754 | 11/1986 | Kikuchi et al. | 174/52.1 |
| 5,287,479 | 2/1994 | Masaru et al. | 323/359 |
| 5,592,137 | 1/1997 | Levran et al. | 336/195 |
| 5,742,218 | 4/1998 | Yamaguchi | 336/192 |

*Primary Examiner*—Adolf Deneke Berhane
*Attorney, Agent, or Firm*—Evenson, McKeown, Edwards & Lenahan, PLLC

[57] ABSTRACT

In a flyback transformer, an insulating cover is interposed between a main body casing and a focusing pack casing. A through-hole is formed through a ceramic resistor accommodated in the focusing pack casing. A fixing hole is formed through the insulating cover in a coaxial relationship with the through-hole. A slider is fixed on a rotatable knob for a variable resistor, which is supported on the focusing pack casing. One of two tongues of the slider is maintained in contact under pressure with a variable resistor of the ceramic resistor, and the other tongue is arranged coaxially with the fixing hole and is maintained in contact under pressure with a wire-shaped output terminal. The terminal is press-fitted in the fixing hole. Another flyback transformer is also disclosed, which comprises a cylindrical holder portion. An exposed portion of a conductor of a voltage output lead wire is formed in an L-shaped bent portion which is press-fitted in the holder portion, whereby the L-shaped bent portion is resiliently held at a basal portion thereof. A conductive rubber is connected to an output terminal. A free end portion of the conductor extends out from the holder portion into the conductive rubber.

14 Claims, 23 Drawing Sheets

FLYBACK TRANSFORMER

BACKGROUND OF THE INVENTION a) Field of the Invention

This invention relates to a flyback transformer for applying focusing voltages and, if necessary, screen voltages to a cathode-ray tube such as a television receiver or a color display.

b) Description of Related Art

First Conventional Art

A flyback transformer which is employed in a television receiver, color display or the like generates high voltages of from 20 to 30 kV, and supplies high d.c. voltages to the anode of a cathode-ray tube and at the same time, also supplies focusing voltages of from 5 to 10 kV and screen voltages of from 100 to 1,000 V.

FIG. 26 is a circuit diagram, which shows the manner of connection of a flyback transformer, a cathode-ray tube, high-voltage coils, etc. The flyback transformer 1 is composed of a low-voltage coil 2, the high-voltage coils 3, diodes 4, and so on. The cathode-ray tube 5 is connected to electrodes 6,6',6" at an output part of the flyback transformer 1. These electrodes 6',6" are output electrodes for voltages obtained as a result of division of each input voltage by a resistor assembled in the flyback transformer 1.

This resistor is composed in combination of fixed resistors 7*a*,7*c*,7*e* and variable resistors 7*b*,7*d*. In general, these resistors are collectively called a "focusing pack". Numeral 8 indicates film capacitors, while numeral 9 designates a fixed resistor.

FIG. 27 is a cross-sectional view of a conventional flyback transformer, in which those parts of the flyback transformer which are the same as corresponding parts in FIG. 26 are indicated by the same reference numerals. A low-voltage coil 2, high-voltage coils 3 with diodes 4 mounted thereon, an insulating material 10, and the like are accommodated in a plastic-made main body casing 11 of the flyback transformer 1. Accommodated in a focusing pack casing 17 are a ceramic resistor 13 with metal terminals 12*a*–12*d* soldered thereon, conductive rubbers 14*a*–14*d* connected to the metal terminals 12*a*–12*d*, a rotatable knob 15 for variable resistors, and sliders 16. An insulating cover 18 is fitted in the focusing pack casing 17 to make up a focusing pack. When each rotatable knob 15 for the corresponding variable resistor is pressed in a direction C (in a leftward direction as viewed in the figure), external force is directly applied to the ceramic resistor 13.

FIG. 28 is a pattern diagram of the ceramic resistor 13. The ceramic resistor 13 has been formed by printing and baking a resistive layer 20 on a ceramic substrate 19. FIG. 28 illustrates fixed resistor portions 7*a*',7*c*',7*e*', variable resistor portions 7*b*',7*d*', and electrodes 21*a*–21*d*. The electrode 21*a* is a high-voltage input electrode for the resistor 13, the electrodes 21*b*,21*c* are output electrodes for focusing and screen voltages, and the electrode 21*d* is a ground electrode.

As is illustrated in FIG. 29, one of two tongues of each slider 16, i.e., a tongue 16*a* slides on the corresponding variable resistor portion 7*b*' or 7*d*' (the resistor 20) in such a state that the tongue 16*a* is always maintained in contact under pressure with corresponding variable resistor portion, while the other tongue 16*b* is always located on and maintained in contact under pressure with a corresponding movable shaft 22 or 22', whereby focusing and screen voltages are outputted. To assure the avoidance of a discharge irrespective of the position of the slider 16, distances A',A' are left out between the resistor patterns.

Second Conventional Art

FIG. 30 is a plan view of a focusing pack in another conventional flyback transformer, while FIG. 31 is a plan view of the flyback transformer formed by integrally combining the focusing pack with a flyback transformer main body. These figures show coverings 100 for focusing voltage output lead wires, a covering 101 for a screen voltage output lead wire, connections 102 formed by winding conductors of the lead wires around corresponding terminals of the focusing pack and soldering them together, a focusing pack casing 103, and a fixed resistor 104.

In this conventional flyback transformer, the focusing voltage output lead wires and screen voltage output lead wire are connected to the corresponding terminals of the focusing pack by winding the conductors of the lead wires around the corresponding terminals and soldering them together.

As has been described above in connection with the first conventional art, a ceramic resistor is accompanied by a problem in that upon proceeding with a dimensional reduction of a flyback transformer, the size of the ceramic resistor cannot be reduced because sufficient creep distances must be left out between individual resistor patterns.

Further, the flyback transformer according to the first conventional art has the construction that, when external force is applied to any one of the rotatable knobs for the corresponding variable resistors in the axial direction of the rotatable knob, the external force is directly applied to the ceramic resistor. This construction therefore involves a potential risk that the ceramic substrate may be broken.

As has been described above with respect to the second conventional art, the conductor of each lead wire is wound around and soldered on its corresponding terminal of the focusing pack. The flyback transformer according to the second conventional art is therefore accompanied by drawbacks in that automated mounting is hardly applicable, easy connection is not feasible, and the efficiency of assembling work is poor.

SUMMARY OF THE INVENTION

A first object of the present invention is therefore to solve the above-described problem of the first conventional art and to provide an economical flyback transformer which permits a dimensional reduction.

A second object of the present invention is to eliminate the above-described potential risk of the first conventional art and to provide an economical and reliable flyback transformer which permits a dimensional reduction and can protect its ceramic resistor from damage by external force.

A third object of the present invention is to eliminate the drawbacks of the second conventional art and to provide a flyback transformer which enables easy connection of voltage output lead wires, permits automated mounting and can achieve an improvement in the productivity.

To achieve the first object, the present invention, in one aspect thereof, provides a flyback transformer provided with a main body casing of the flyback transformer and a focusing pack casing, said main body casing accommodating therein predetermined electronic parts including a high-voltage coil, said focusing pack casing supporting thereon a rotatable knob for a variable resistor and accommodating therein predetermined electronic parts including a ceramic resistor, and said main body casing and said focusing pack casing being combined together so that the main body casing and the focusing pack casing oppose each other on sides of openings thereof, wherein:

an insulating cover is interposed between the main body casing and the focusing pack casing;

a through-hole is formed through the ceramic resistor, which is accommodated in the focusing pack casing, in association with a part of the ceramic resistor where the variable resistor is printed, and a fixing hole is formed through the insulating cover in a coaxial relationship with the through-hole; and one of two tongues of a slider which is fixed on the rotatable knob for the variable resistor is maintained in contact under pressure with the variable resistor of the ceramic resistor, and the other tongue of the slider is arranged coaxially with the fixing hole and is maintained in contact under pressure with a wire-shaped output terminal for focusing or screen voltages, said terminal being press-fitted in the fixing hole.

To attain the second object, the present invention, in a second aspect thereof, features that the flyback transformer has a structure so that external force applied in an axial direction of the rotatable knob for the variable resistor is borne at a peripheral portion of the fixing hole in the insulating cover.

To materialize the third object, the present invention, in a third aspect thereof, provides a flyback transformer comprising:

a cylindrical holder portion made of a molded body of a synthetic resin and defining a slit extending in an axial direction of the cylindrical holder portion, a voltage output lead wire (for example, a focusing voltage output lead wire or a screen voltage output lead wire) composed of a covering and a conductor, said conductor being exposed at a portion thereof without the covering, said exposed portion of the conductor being formed in an L-shaped bent portion which is press-fitted in the cylindrical holder portion, whereby the L-shaped bent portion being resiliently held at a basal portion thereof by the cylindrical holder portion, and a conductive rubber connected to an output part;

wherein a free end portion of the conductor extends out from the cylindrical holder portion and is inserted in the conductive rubber.

According to the first aspect of the present invention, one of the two tongues of the slider fixed on the rotatable knob for the variable resistor is maintained in contact under pressure with the ceramic resistor, and the other tongue of the slider is maintained in contact under pressure with the wire-shaped output terminal for focusing or screen voltages, said terminal being press-fitted in the fixing hole, so that focusing voltages and, if necessary, screen voltages can be outputted. It is therefore unnecessary to form on the ceramic resistor an output resistor pattern and electrode for outputting focusing voltages and, if necessary, screen voltages. The ceramic resistor can therefore be easily reduced in dimensions, thereby making it possible to provide the flyback transformer at low cost.

In the first aspect of the present invention, it is preferred to provide the rotatable knob for the variable resistor, on a side thereof where the slider is fixed, with a wall so that a basal portion of the slider is surrounded by the wall and a free end of the wall extends in the through-hole of the ceramic resistor. This feature can bring about improvements in both creepage withstand voltage and through withstand voltage.

In the first aspect of the present invention, the rotatable knob for the variable resistor may preferably be provided, on a side thereof where the slider is fixed, with a recess which permits flexion of the other tongue of the tongue. This feature allows the tongue to surely undergo resilient deformation, so that cushioning effects of the tongue can be fully exhibited.

In the first aspect of the present invention, the other tongue of the slider may preferably be maintained in contact under pressure with a tip portion of the wire-shaped output terminal. The other tongue, in association with the tongue maintained in resilient contact with the ceramic resistor, can show cushioning effects for the ceramic resistor.

In the first aspect of the present invention, the other tongue of the slider may preferably be maintained in contact under pressure with a peripheral surface of the wire-shaped output terminal. Accordingly, the other tongue always acts in the direction of an axis of the wire-shaped output terminal so that the other tongue is not detached from the wire-shaped output terminal. Desirably, the other tongue of the slider may define a recess in which an outer peripheral portion of the wire-shaped output terminal is partly fitted. Owing to this recess, the precise positioning of the other tongue is assured so that the outer tongue is not detached from the wire-shaped output terminal.

In the first aspect of the present invention, the slider may be provided at a basal portion thereof with plural engaging lugs extending out from the basal portion, and each of the engaging lugs may be in engagement with a portion of the rotatable knob for the variable resistor. This feature has a merit such that the slider can be simply and surely attached to the rotatable knob for the variable resistor.

According to the second aspect o f the present invention, when the rotatable knob for the variable resistor is applied with external force in an axial direction, the resulting load is mostly exerted on the peripheral portion of the fixing hole of the insulating cover. The external pressure is not applied directly to the ceramic resistor, and only the spring pressure of the slider is applied to the ceramic resistor. The ceramic resistor can therefore be protected from damage, so that the flyback transformer is provided with high reliability.

In the second aspect of the present invention, the insulating cover may desirably have a fixing cylindrical portion of a large thickness as the peripheral portion of the fixing hole. The fixing cylindrical portion of the large thickness can surely hold the wire-shaped output terminal, can effectively bear load applied in the axial direction of the rotatable knob for the variable resistor, can protect the ceramic resistor more surely, and can improve the creepage withstand voltage and through withstand voltage.

According to the third aspect of the present invention, the fixing and connection of the voltage output lead wire can be easily achieved by press-fitting the conductor in the slit of the cylindrical holder portion and inserting the conductor in the conductive rubber. Automated mounting is therefore feasible, thereby permitting an improvement in productivity. Further, the L-shaped bent portion of the conductor is resiliently held around the basal portion thereof by the cylindrical holder portion, so that the fixing of the conductor is assured, thereby achieving an improvement in reliability. Moreover, the conductor is firmly held within the slid of the cylindrical holder portion so that, upon inserting the conductor into the conductive rubber, the conductor remains free from bending or the like and the efficiency of the assembling work is good.

In the third aspect of the present invention, it may be preferred to arrange a pinch rib in the vicinity of the cylindrical holder portion to prevent loosening of the conductor and also to resiliently hold a portion of the conductor by the pinch rib. The pinch rib therefore assures the fixing of the voltage output lead wire. Desirably, a fitted groove may be formed extending from a basal portion of the pinch rib to a basal portion of the cylindrical holder portion, whereby another portion of the conductor may be resiliently fitted in the fitted groove. Since the conductor is also held by the fitted groove, the fixing of the voltage output lead wire is assured further.

In the third aspect of the present invention, the cylindrical holder portion may preferably define at a lower end portion thereof an L-shaped groove portion in communication with the slit, and the L-shaped bent portion of the conductor may preferably be press-fitted in the L-shaped groove portion and also in the slit of the cylindrical holder portion. As the L-shaped bent portion of the conductor is held over the L-shaped groove and the slit of the cylindrical holder portion, the fixing of the voltage output lead wire is assured.

In the third aspect of the present invention, it may be preferred to arrange the cylindrical holder portion on a lead wire holder casing, to form an engaging device on one of the lead wire holder casing and a focusing pack casing to which the lead wire holder case is to be attached, to form an engaged device on the other one of the lead wire holder casing and the focusing pack casing, and to maintain the conductor inserted in the conductor rubber on the basis of engagement between the engaging portion and the engaged portion. This feature has a merit such that the conductor is not pulled out of the conductive rubber by external force or the like.

BRIEF DESCRIPTION OF THE DRAWINGS

FIG. 26 is the circuit diagram illustrating the manner of connection of the flyback transformer, the cathode-ray tube, the high-voltage coils and so on;

DETAILED DESCRIPTION OF THE INVENTION AND PREFERRED EMBODIMENTS

The flyback transformer according to the first embodiment of the present invention will hereinafter be described based on FIG. 1 through FIG. 9.

Figure 1:
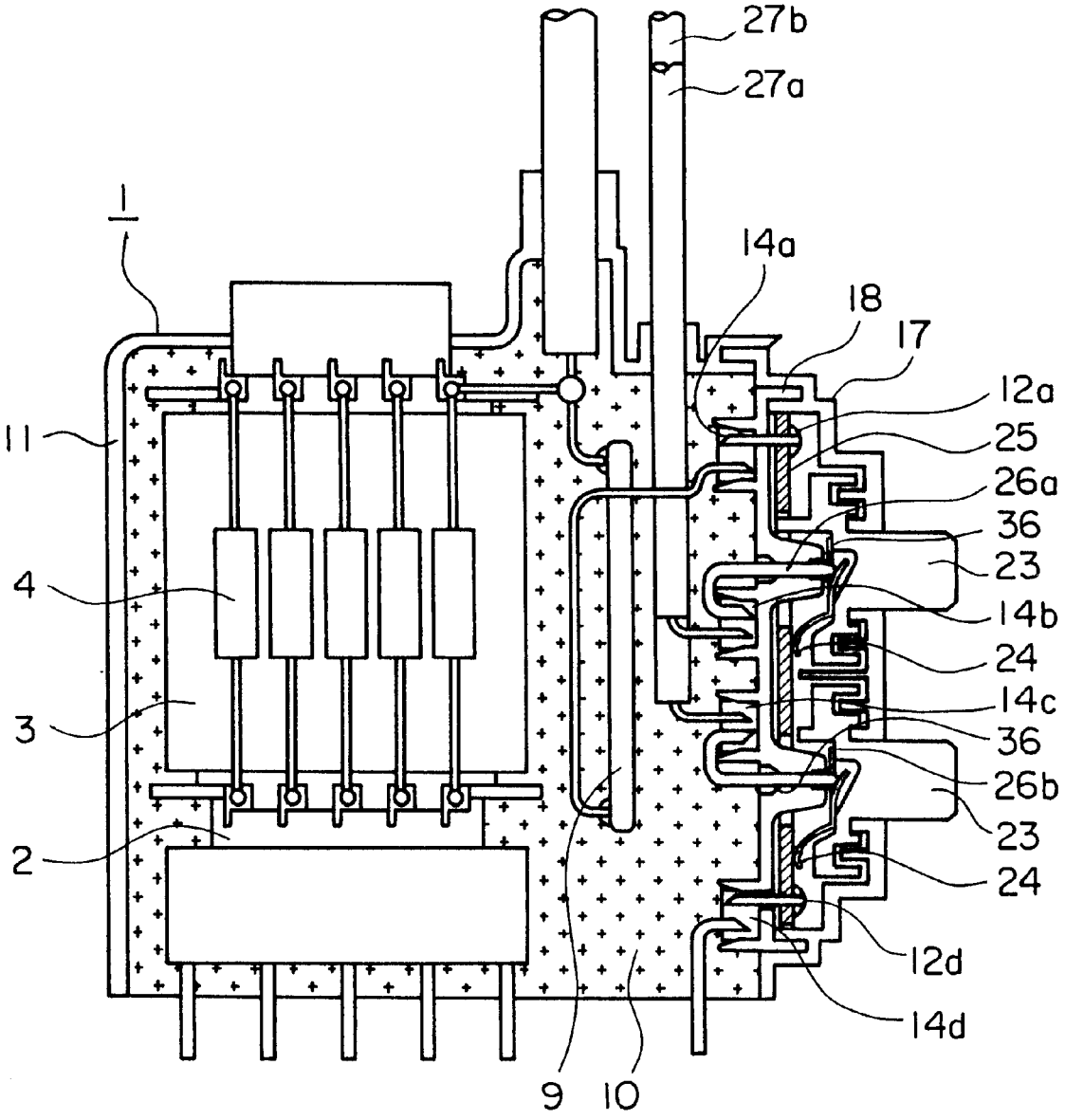
FIG. 1 is a cross-sectional view of a flyback transformer according to a first embodiment of the present invention.

As is illustrated in FIG. 1, predetermined electronic parts such as a low-voltage coil 2 and high-voltage coils 3 with diodes 4 connected thereto are accommodated in a plastic-made main body casing 11, and an opening is formed in the main body casing 11 on a side of a plastic-made focusing pack casing 17.

Predetermined electronic parts—such as rotatable knobs 23 for variable resistors, sliders 24 and a ceramic resistor 25 with metal terminals soldered thereon—are accommodated in the focusing pack casing 17, and a focusing pack insulating cover 18 made of plastics is fitted in the focusing pack casing 17 to make up a focusing pack.

A voltage outputted from each high-voltage coil 3 flows through a fixed resistor 9 and the metal terminal 12a, and is applied to the focusing pack. Divided voltages are adjusted by sliding the slider 24 fixed on the rotatable knob 23 for the variable resistor, and are outputted from focusing voltage and screen voltage output wires 27*a*,27*b* via wire-shaped output terminals 26*a*,26*b* press-fitted in the insulating cover 18.

Figure 2:
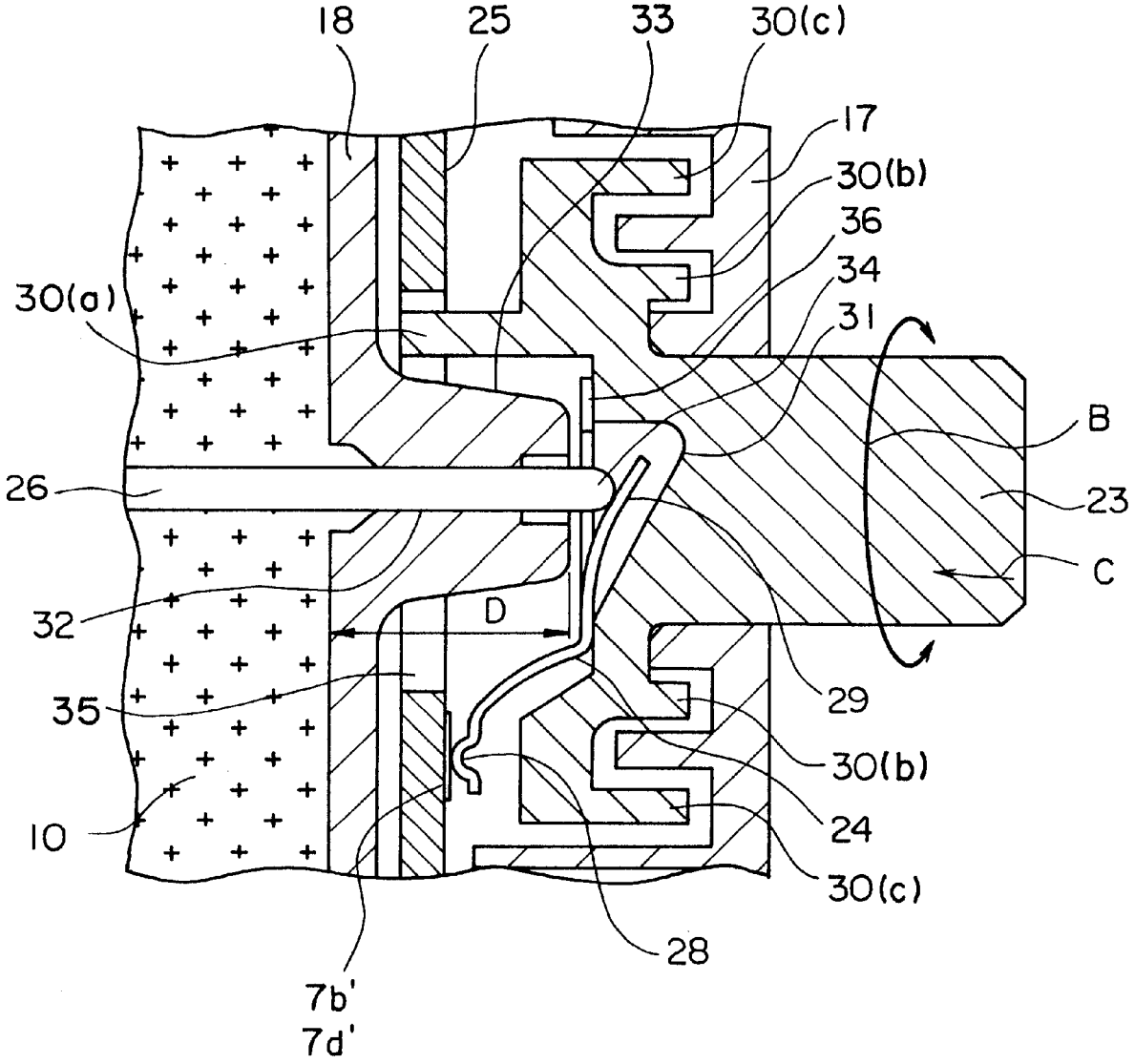
FIG. 2 is an enlarged fragmentary view of connections between a slider and a ceramic resistor and wire-shaped terminal for output voltages in the flyback transformer.
Figure 7A:
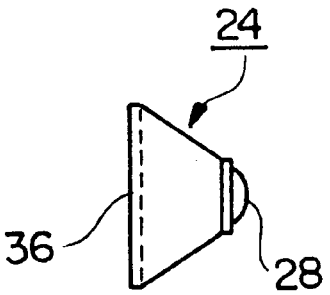
FIGS. 7(*a*), 7(*b*) and 7(*c*) are a side view, plan view and cross-sectional view showing the shape of one example of the slider.
Figure 7B:
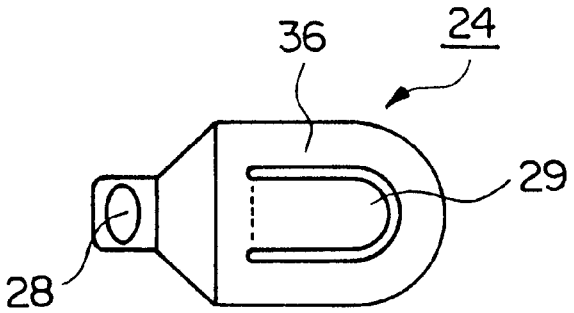
Figure 7C:
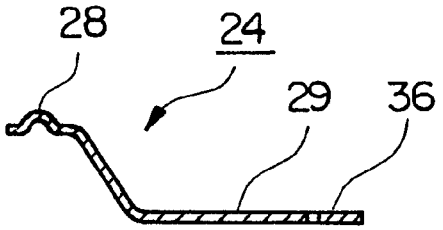

As is illustrated in FIG. 2 and FIGS. 7(*a*) through 7(*c*), each slider 24 has been formed by stamping a plate having spring resiliency and corrosion resistivity, such as a stainless steel plate. One of its two tongues, i.e., a tongue 28 is bent up and is provided at a free end portion thereof with a tang. The tongue 28 is maintained in contact under pressure with its corresponding variable resistor 7*b*' or 7*d*' of the ceramic resistor 25. The other tongue 29, which has been formed inside a base portion 36 of the slider 24 by forming a U-shaped cut in the base portion 36, is maintained in point-to-point contact under pressure with a tip portion 34 of a wire-shaped output terminal 26 for focusing voltages and screen voltages, so that the other tongue 29 is allowed to resiliently undergo some bent deformation.

Figure 8A:
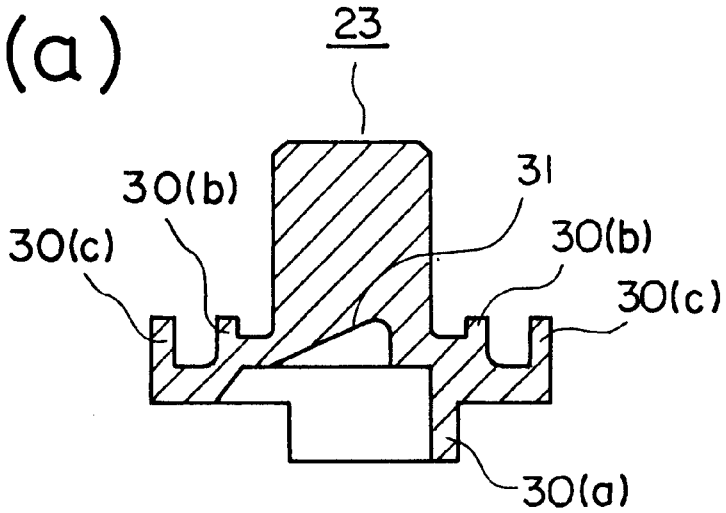
FIGS. 8(*a*), 8(*b*) and 8(*c*) are a cross-sectional view, bottom view and plan view depicting the shape of one example of a rotatable knob for a variable resistor.
Figure 8B:
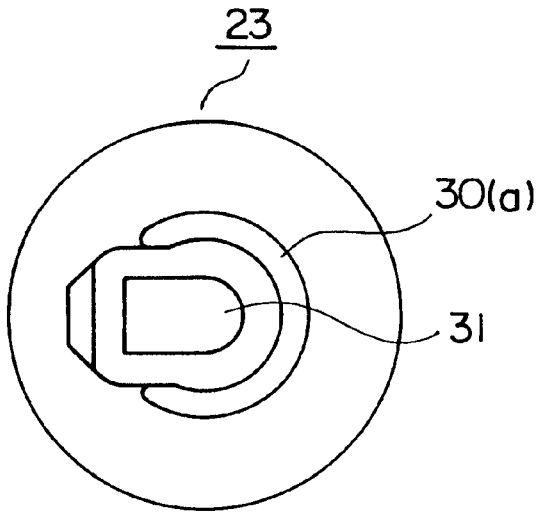
Figure 8C:
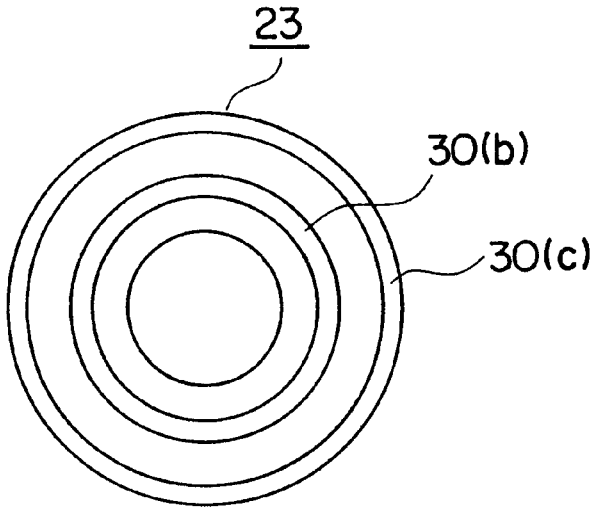
Figure 9:
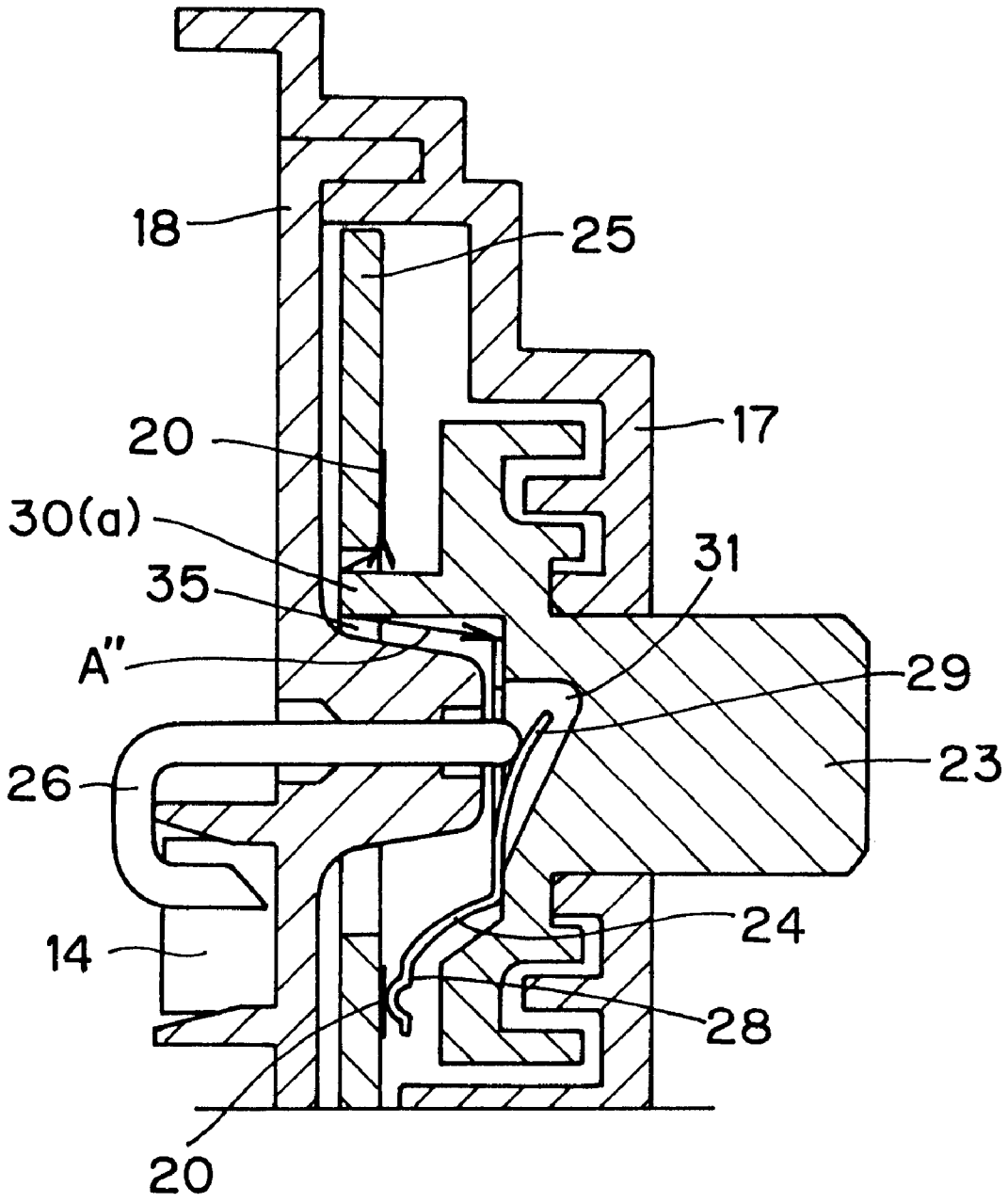
FIG. 9 is an enlarged fragmentary cross-sectional view of the connections between the slider and the ceramic resistor and wire-shaped terminal for output voltages in the flyback transformer.

FIGS. 8(*a*) to 8(*c*) show the shape of each rotatable knob 23 for the corresponding variable resistor. Each rotatable knob 23 is formed of a molded body of a synthetic resin. To increase the creepage withstand voltage and through withstand voltage, the rotatable knob 23 is provided on one side thereof with a wall 30(*a*) having a substantially C-shaped configuration as viewed in transverse cross-section [see FIGS. 8(*a*) and 8(*b*)] and is also provided on the other side thereof with ring-shaped walls 30(*b*),30(*c*) [see FIGS. 8(*a*) and 8(*c*)]. As is illustrated in FIG. 9, the wall 30(*a*) extends into a through-hole 35 of the ceramic resistor 25 to leave out a creep distance A". Further, the rotatable knob 23 for its corresponding variable resistor is also provided, at its central portion located opposite the slider 24, with a recess 31 so that flexion of the tongue 29 is not interfered with. The slider 24 is fixed on the rotatable knob 23 for the corresponding variable resistor by an appropriate means such as lugs or notches although not illustrated in any figure.

As is illustrated in FIG. 2, the insulating cover 18 is provided with a fixing hole 32 of a small diameter on an extension of a central axis of the rotatable knob 23 for the variable resistor. The wire-shaped output terminal 26 for focusing voltages and screen voltages is press-fitted in the fixing hole 32 so that an insulating material 10 does not penetrate to the interior of the focusing pack. To improve the creepage withstand voltage and through withstand voltage, a cylindrical fixing portion 33 which surrounds the fixing hole 32 is formed thicker to have a thickness D. The wire-shaped output terminal 26 is firmly fixed by the cylindrical fixing portion 33 of the large thickness.

Owing to the provision of the cylindrical fixing portion 33 of the large thickness as described above, an improvement has been made in reliability because, even when external force is applied in the direction C to the rotatable knob 23 for the variable resistor, the resulting load is mostly borne at the cylindrical fixing portion 33 and only spring pressure is applied to the ceramic resistor 25 via the slider 24.

Figure 4:
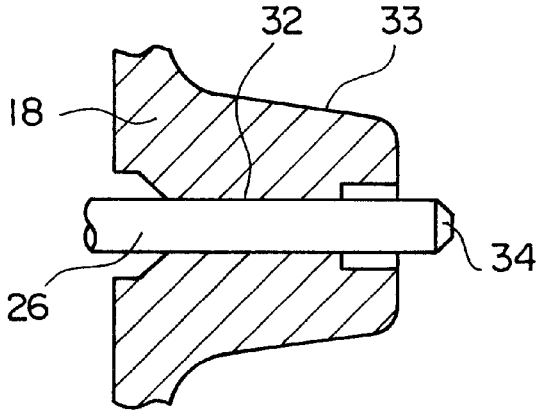
FIG. 4 is a cross-sectional view showing the shape of another specific example of the wire-shaped terminal for output voltages.
Figure 5:
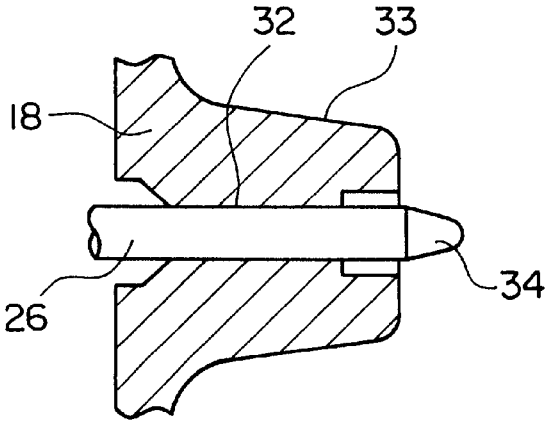
FIG. 5 is a cross-sectional view showing the shape of a further specific example of the wire-shaped terminal for output voltages.

In FIG. 2, the tip portion 34 of the wire-shaped terminal 26 is formed in a semi-spherical shape on the side where the wire-shaped terminal 26 is maintained in contact under pressure with the slider 24. The tip portion 34 can be formed in various shapes as illustrated in FIGS. 3 to 5 insofar as the rotatable knob 23 for the variable resistor can smoothly rotate.

Figure 3:
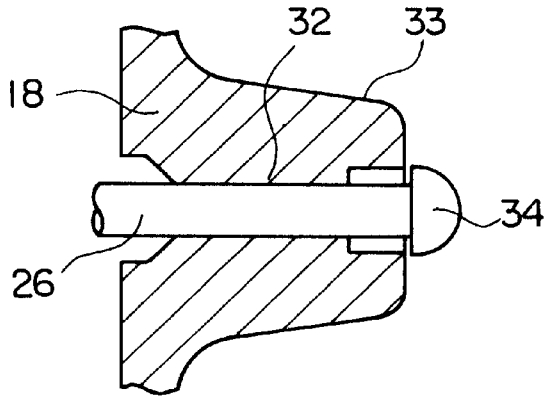
FIG. 3 is a cross-sectional view showing the shape of a specific example of the wire-shaped terminal for output voltages.

FIG. 3 shows one example machined in the course of production steps. Subsequent to press-fitting in the insulating cover 18, stamping was applied. The shapes exemplified in FIG. 4 and FIG. 5 permit advance machining and also machining after having been press-fitted in the insulating cover 18.

Figure 6:
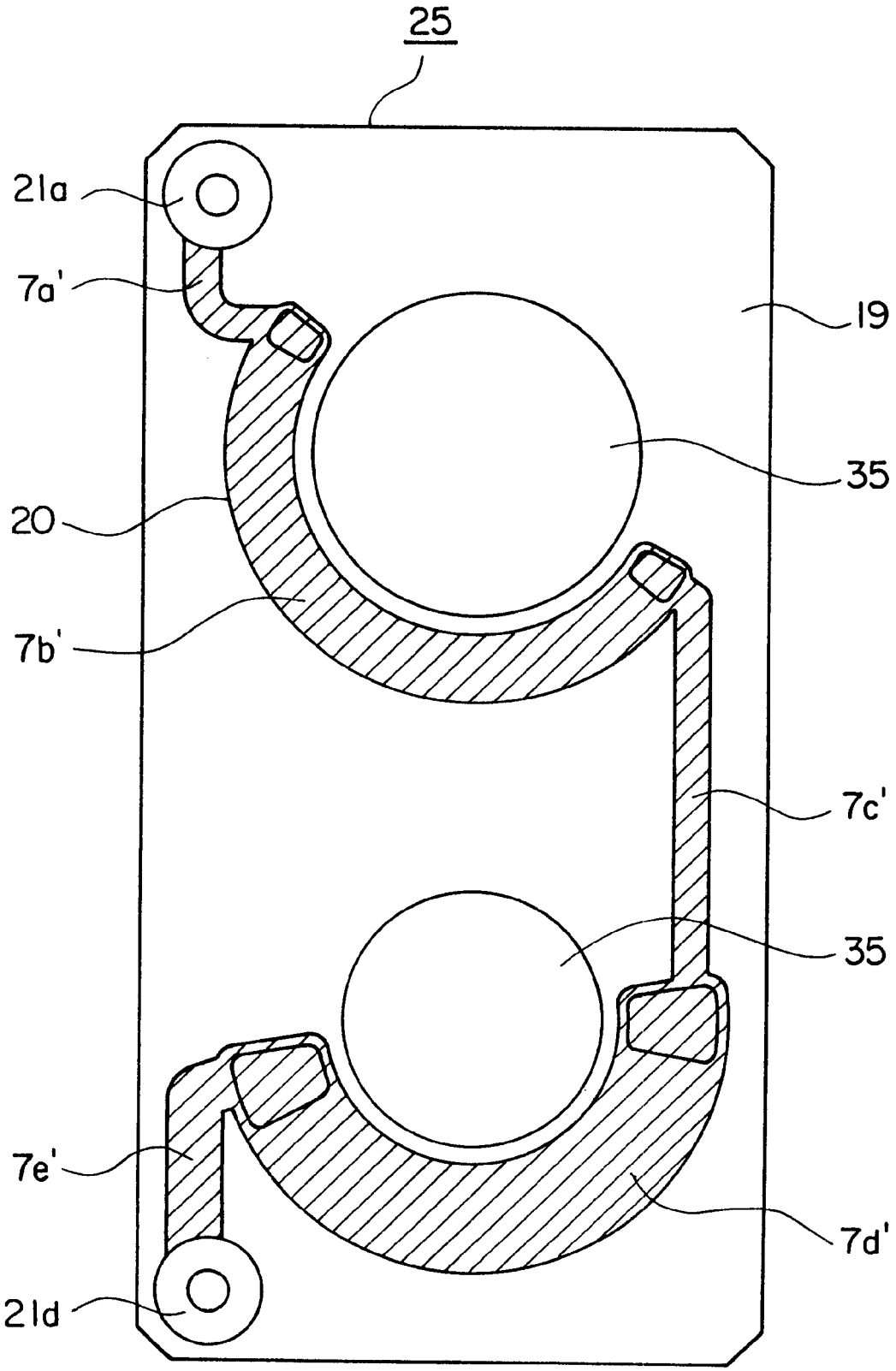
FIG. 6 is a pattern diagram of a ceramic resistor.
Figure 28:
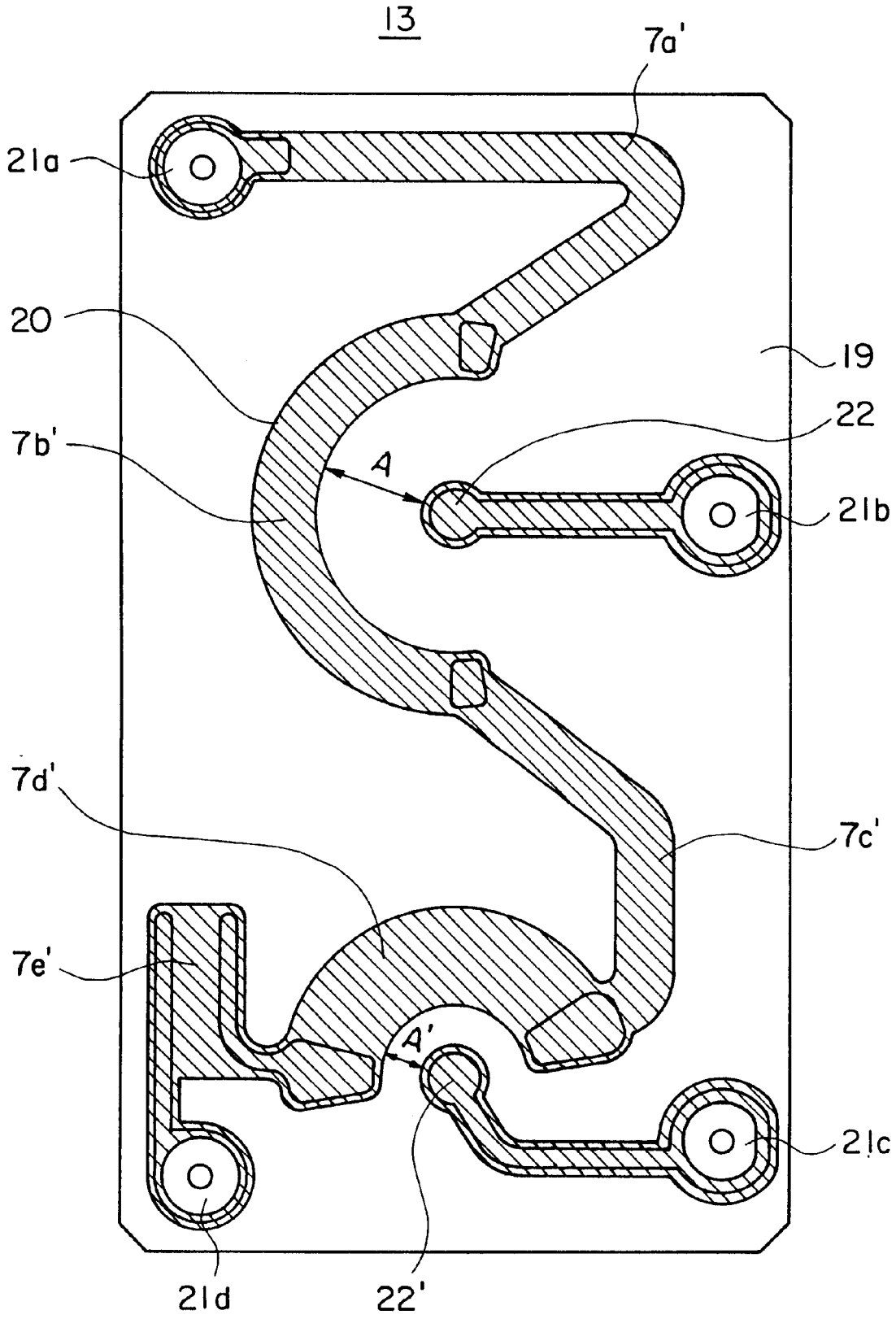
FIG. 28 PRIOR ART
FIG. 28 is the pattern diagram of the ceramic resistor in the first conventional art.
Figure 29:
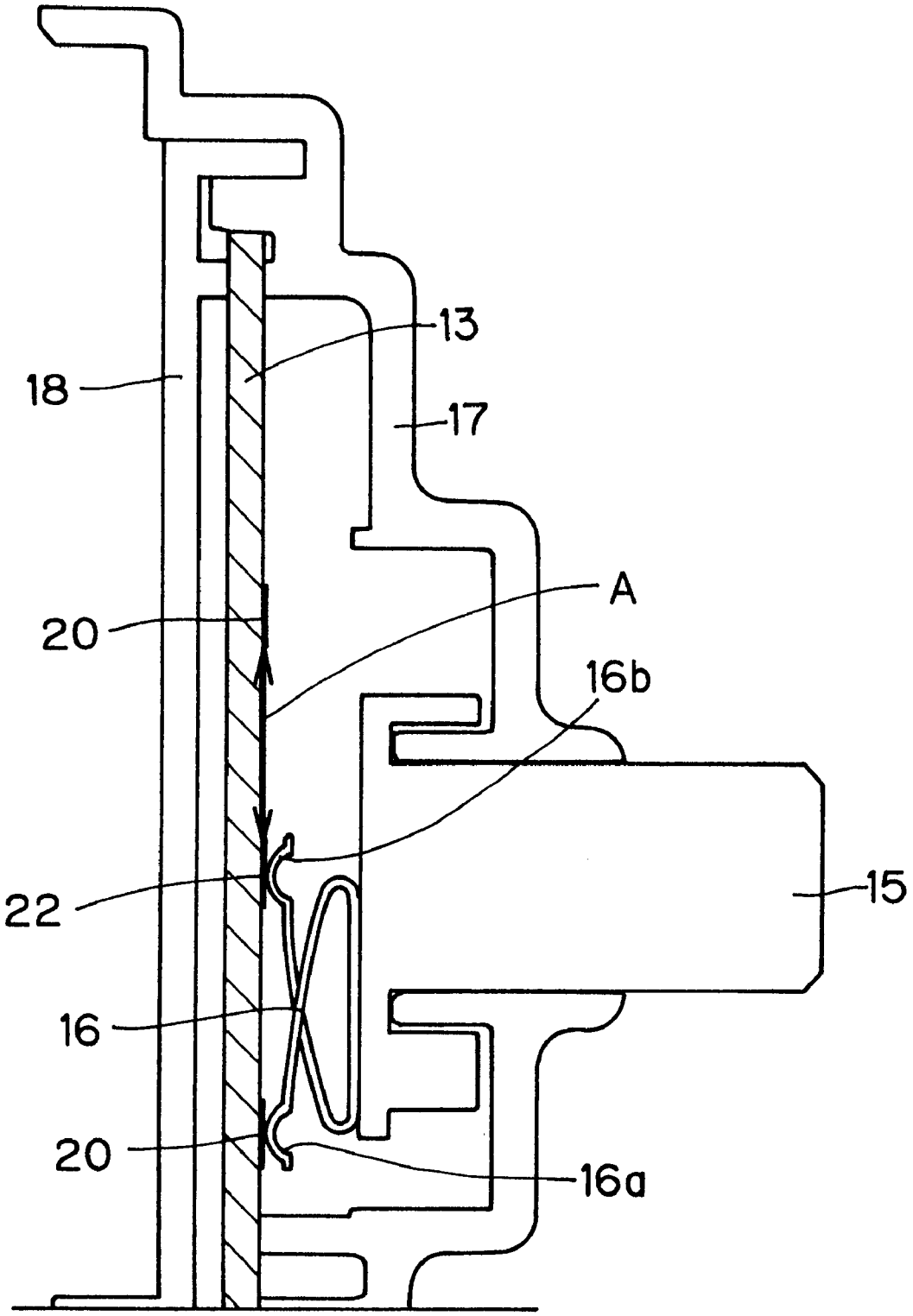
FIG. 29 PRIOR ART
FIG. 29 is the fragmentary cross-sectional view of the flyback transformer according to the first conventional art.
Figure 30:
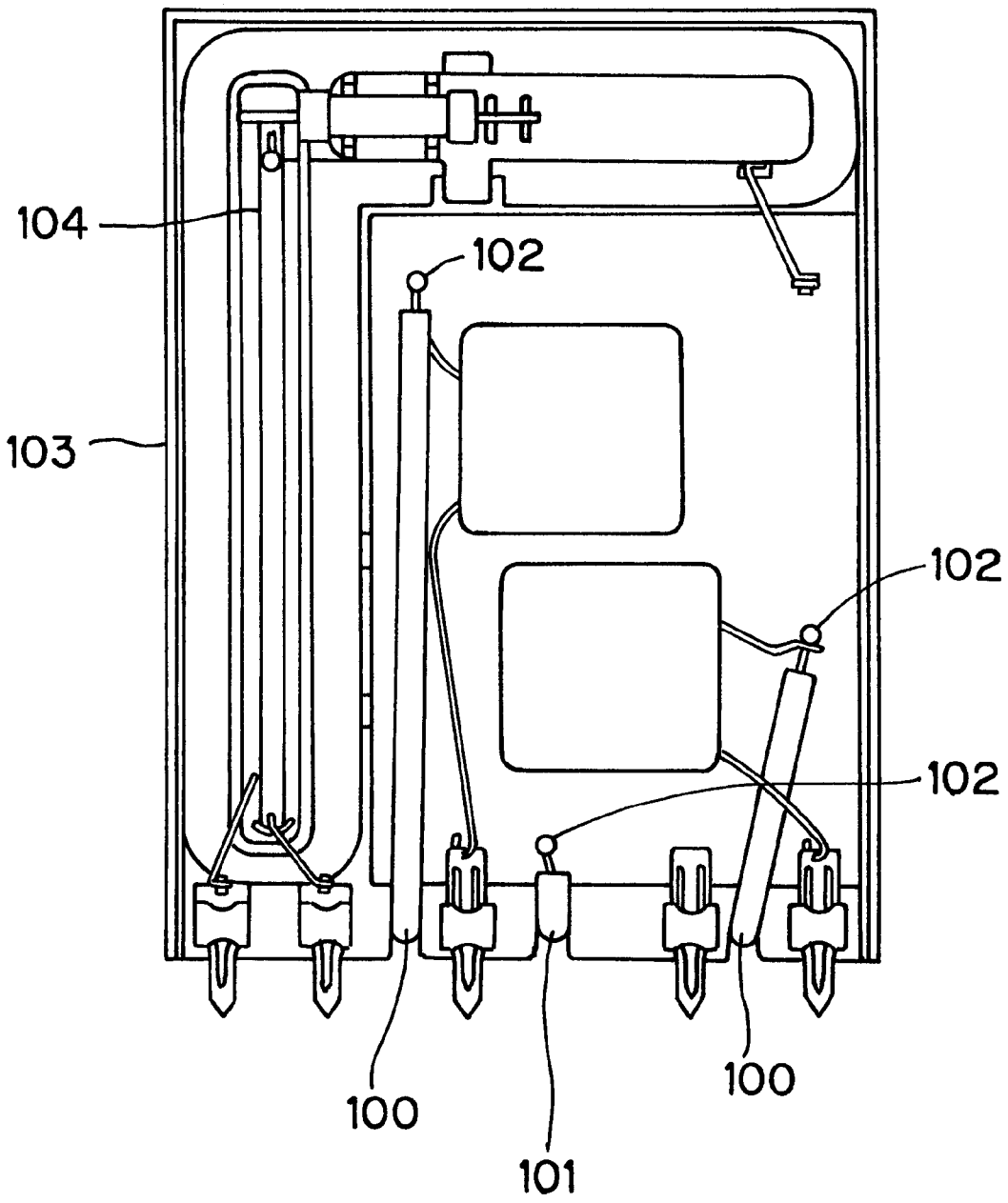
FIG.30 PRIOR ART
FIG. 30 is the plan view of the focusing pack in the flyback transformer according to the second conventional art.
Figure 31:
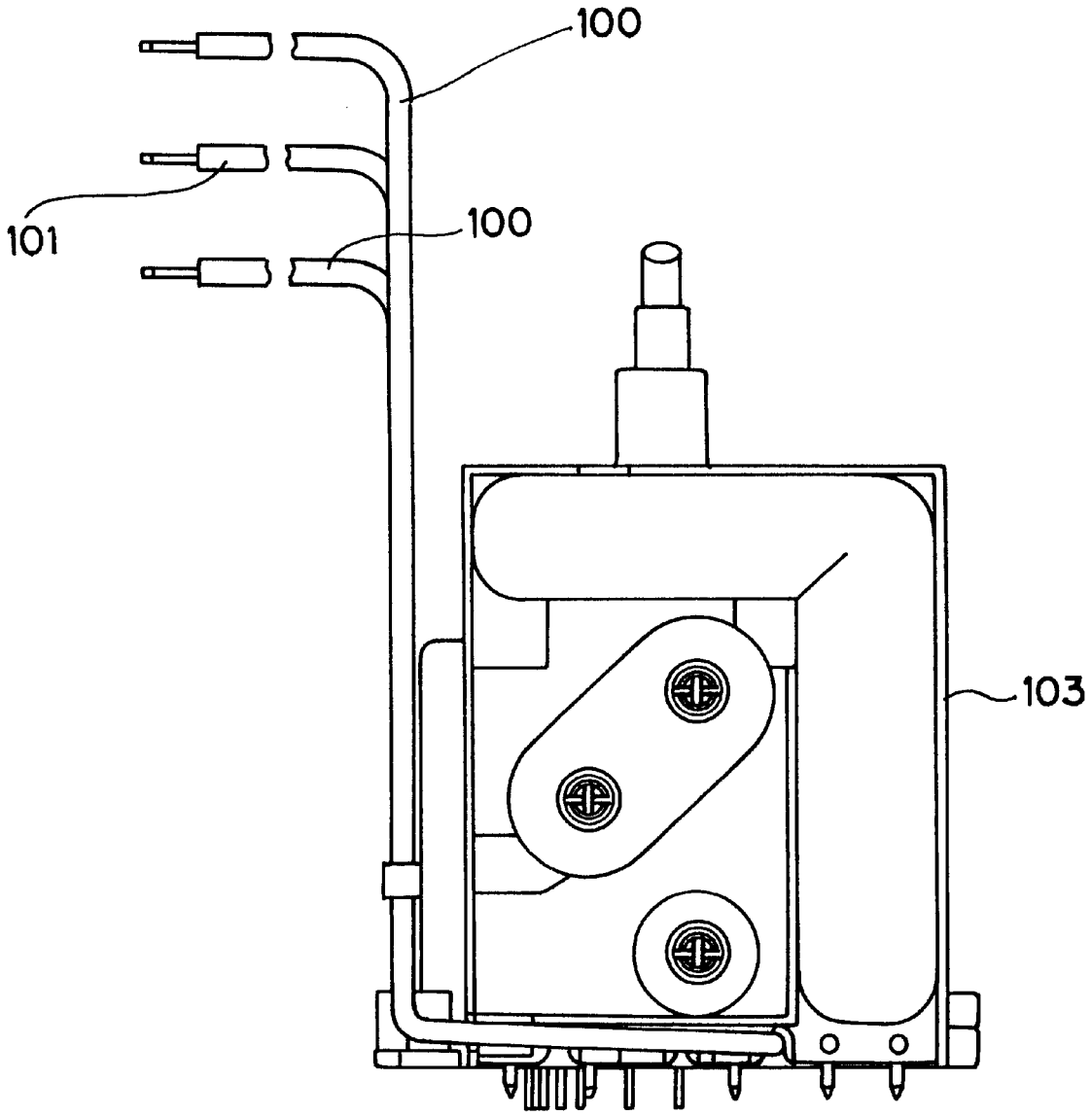
FIG.31 PRIOR ART
FIG. 31 is the plan view of the flyback transformer according to the second conventional art, which is composed of the focusing pack and the fly back transformer main body integrated therewith.

As is illustrated in FIG. 6, the ceramic resistor 25 has been formed by printing and baking a resistive layer 20 on a ceramic substrate 19. FIG. 6 shows fixed resistors 7*a*',7*c*',7*e*', variable resistors 7*b*',7*d*', and electrodes 21*a*,21*d*. The electrode 21*d* is a high-voltage input electrode for the resistor 13, and the electrode 21*d* is a ground electrode. As is shown in the same figure, the through-holes 35 are formed on concave sides of variable resistors 7*b*',7*d*' which are parts where the variable resistors are printed. Different from the conventional art, the output electrodes 21*b*,21*c* for focusing and screen voltages (see FIG. 28) are not arranged. The ceramic resistor 25 can therefore be significantly reduced in dimensions compared with that of the conventional art and, as is shown in the same figure, the pattern configuration has been simplified.

Figure 10:
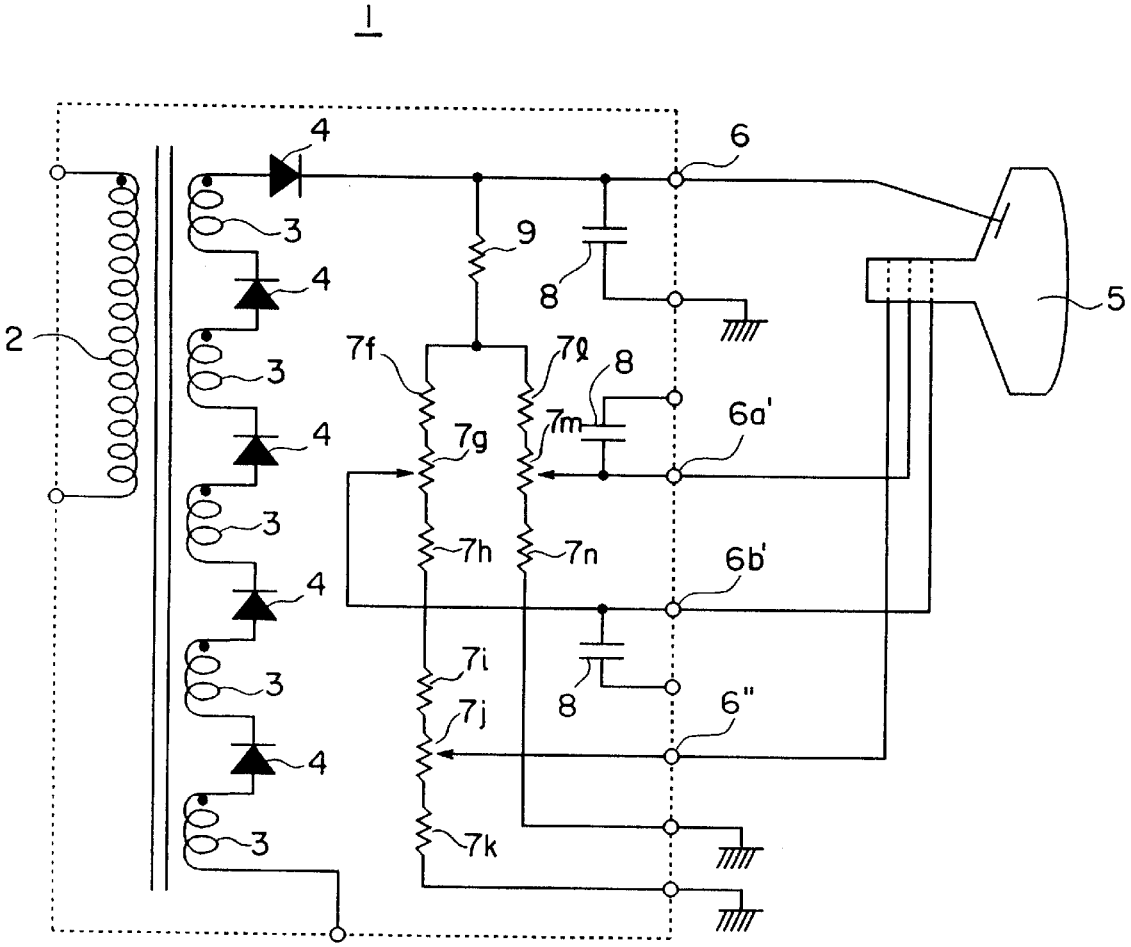
FIG. 10 is a circuit diagram of a flyback transformer of the double focusing type.
Figure 26:
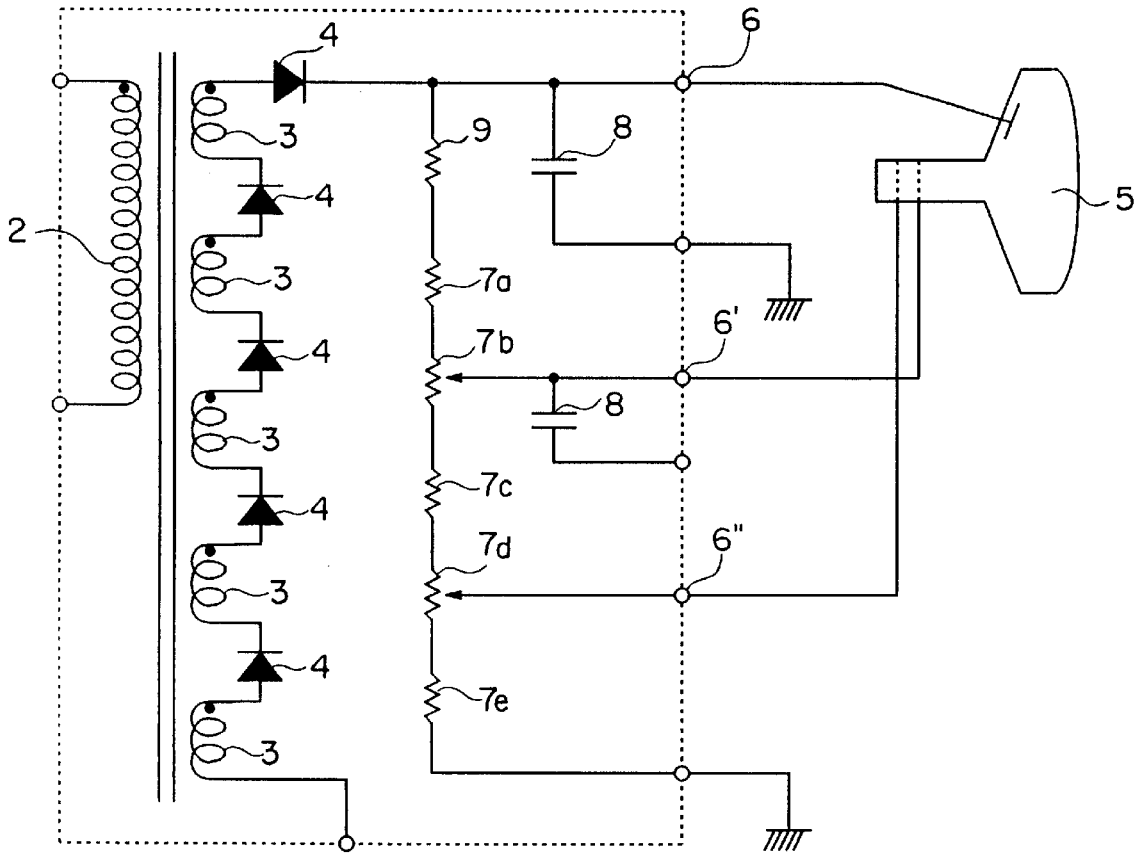
FIG. 26 PRIOR ART
Figure 27:
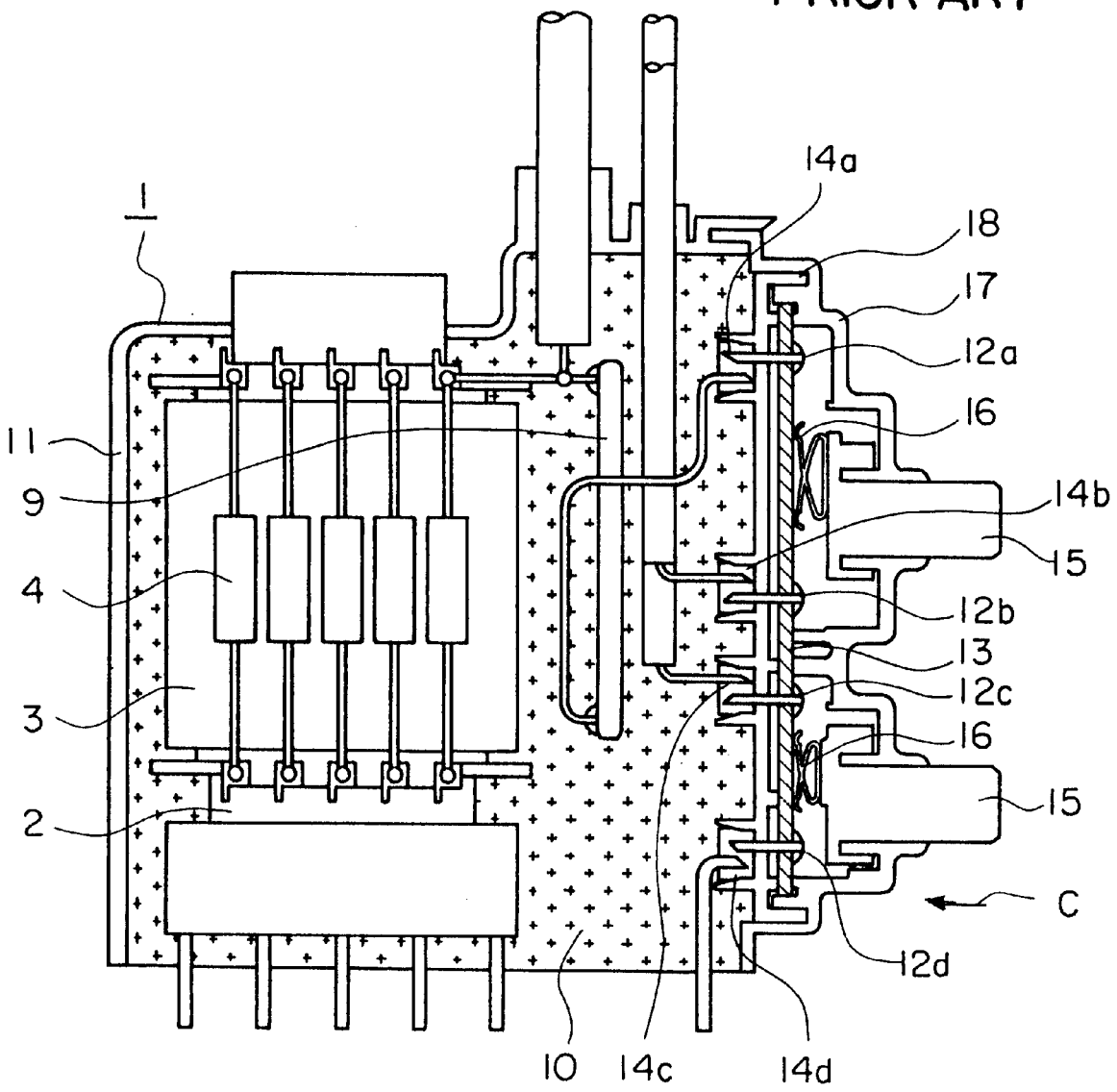
FIG. 27 PRIOR ART
FIG. 27 is the cross-sectional view of the flyback transformer according to the first conventional art.

The first embodiment of the present invention as applied to the single focusing type has been described above. The present invention can however be applied to flyback transformers of any circuit configurations. As an application example, a representative circuit diagram of the double focusing type is illustrated in FIG. 10, in which those parts of the flyback transformer which are the same as corresponding parts in FIG. 26 are indicated by the same reference numerals.

This circuit structure is of the double focus type, and includes focusing electrodes 6*a*',6*b*' and variable resistors 7*m*,7*g* arranged corresponding to the respective focusing electrodes 6*a*',6*b*'.

Figure 11A:
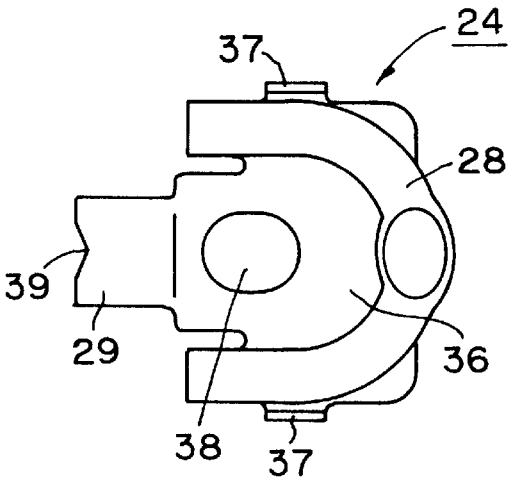
FIGS. 11(*a*), 11(*b*) and 11(*c*) are a plan view, side view and front view illustrating the shape of a slider in a flyback transformer according to a second embodiment of the present invention.
Figure 11B:
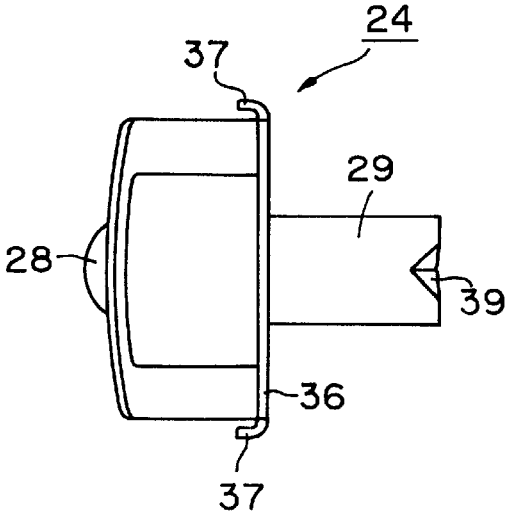
Figure 11C:
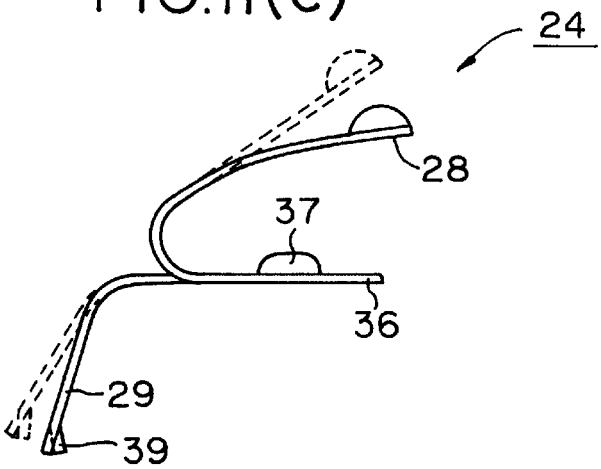

Referring next to FIGS. 11(*a*) through 13, the flyback transformer according to the second embodiment of the present invention will be described.

A slider 24 is formed of a metal plate having resiliency, and as is illustrated in FIGS. 11(*a*) to 11(*c*), is composed of a base portion 36 and two tongues, one being a tongue 28 bent in a direction into a substantially U-shape an the other a tongue 29 bent in a direction opposite to the tongue 28.

Engagement lugs 37,37 are arranged upright on the same side of the base portion 36 so that they are inlined somewhat outwardly from opposite sides of the base portion 36. An engagement hole 38 is formed through the base portion 36 at a substantially central part thereof. The other tongue 29 is provided at a free end portion thereof with a recess 39 in the form of a V-groove formed by bending.

Figure 12A:
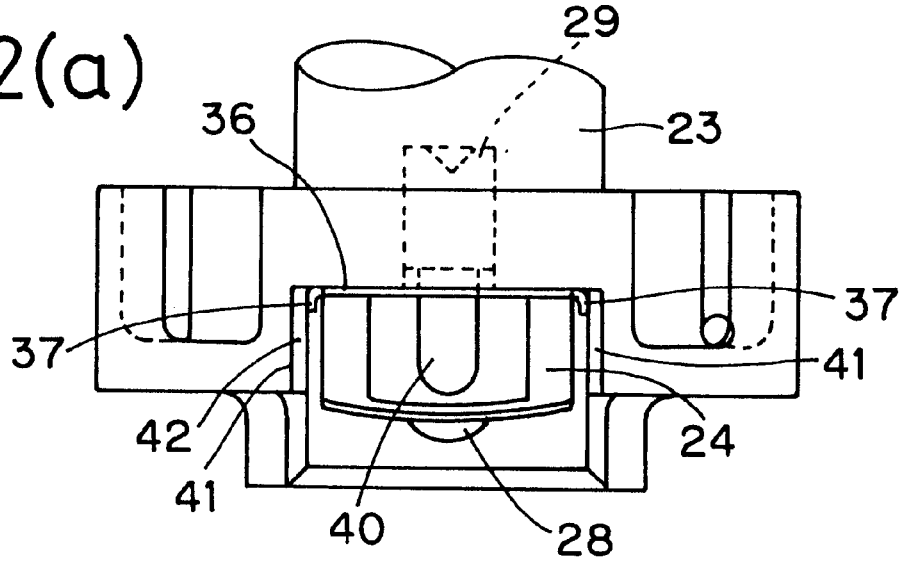
FIGS. 12(*a*) and 12(*b*) are a side view and bottom view depicting the shape of a rotatable knob for a variable resistor, said rotatably knob being provided with the slider.
Figure 12B:
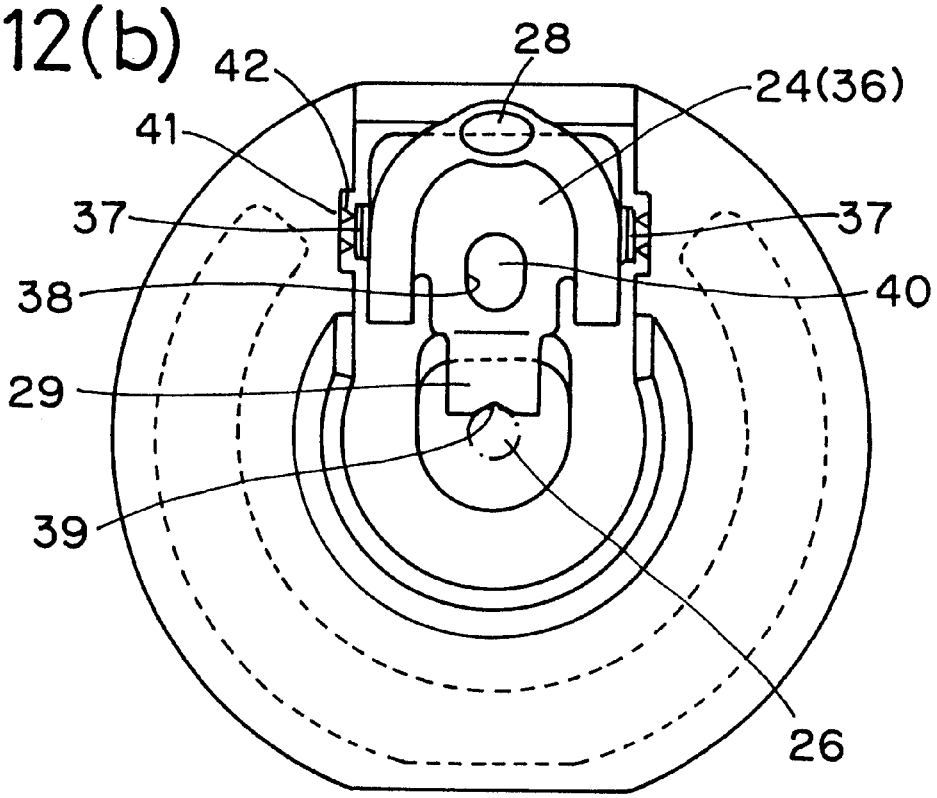
Figure 13:
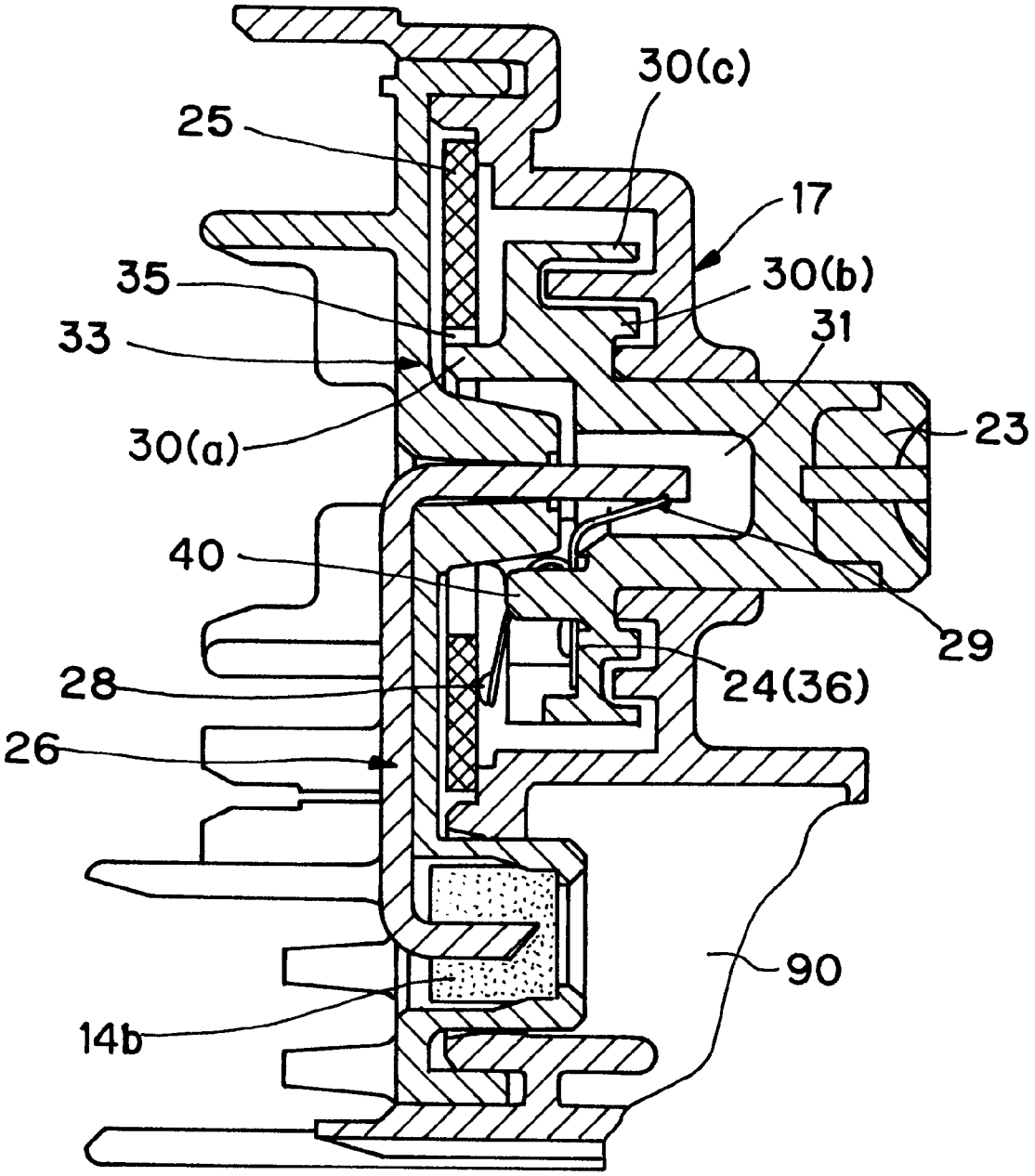
FIG. 13 is an enlarged fragmentary view of the flyback transformer according to the second embodiment of the present invention.

As is shown in FIGS. 12(*a*) and 12(*b*) and FIG. 13, a rotatable knob 23 for the corresponding variable resistor is provided on a slider-mounting side thereof with a lobe 40, and the lobe 40 is press-fitted in the engagement hole 38. As is illustrated in FIGS. 12(*a*) and 12(*b*), the engagement lugs 37,37 are maintained in contact under pressure and hence in engagement with corresponding ribs 42 formed on opposite peripheral walls 41,41 of the rotatable knob 23. Therefore the slider 24 is easily fixed on the rotatable knob 23.

As is illustrated in FIGS. 12(*b*) and 13, different from the first embodiment described above, the other tongue 29 is maintained in contact under pressure with a peripheral surface of a wire-shaped output terminal 26 and an outer peripheral portion of the terminal 26 is fitted at a part thereof in the recess 39 of the tongue 29, whereby the positioning of the tongue 29 is achieved. Designated at numeral 90 in FIG. 13 is a cavity in which a lead wire holder casing is accommodated as will be described subsequently herein.

With reference to FIG. 14 through FIG. 25, the flyback transformer according to the third embodiment of the present invention will be described hereinafter.

Figure 14:
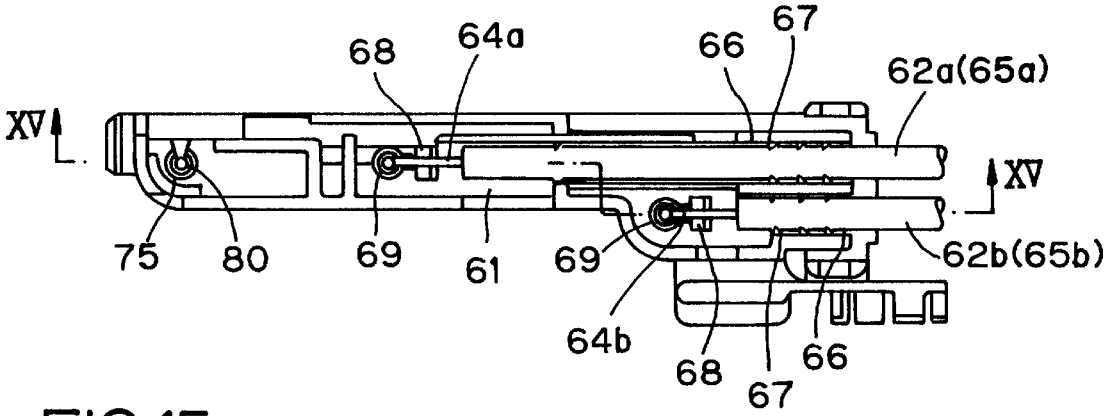
FIG. 14 is a plan view of a lead wire holder casing in a flyback transformer according to a third embodiment of the present invention.
Figure 15:
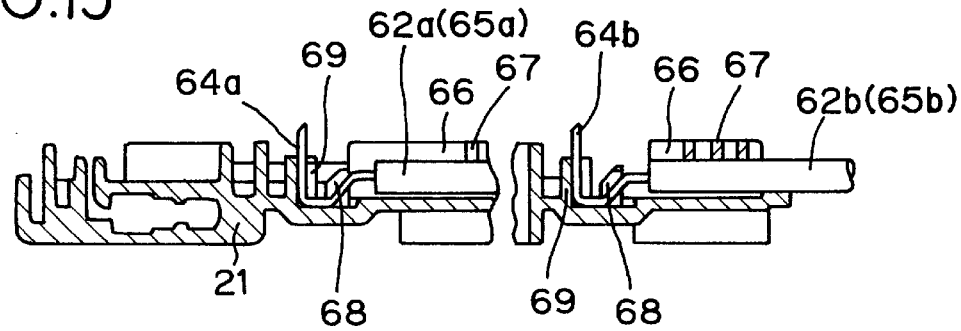
FIG. 15 is a cross-sectional view taken in the direction of arrows XV—XV of FIG. 14.
Figure 16:
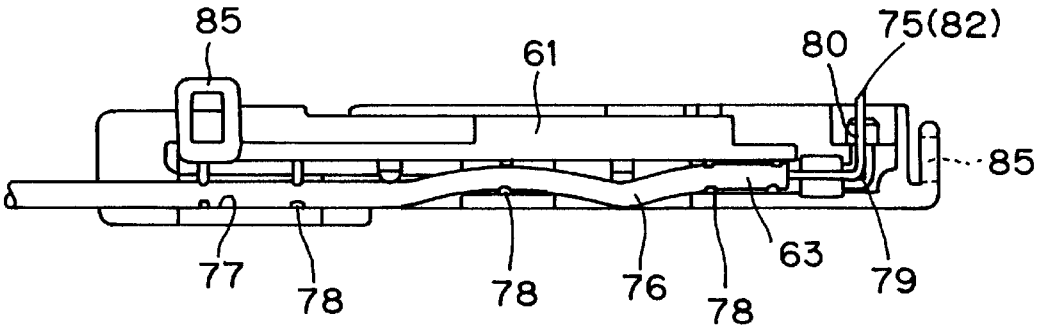
FIG. 16 is a side view of the lead wire holder casing.

A lead wire holder casing 61 formed of a molded body of a synthetic resin is in an elongated shape as depicted in FIG. 14, etc. The lead wire holder casing 61 carries on a top wall thereof two focusing voltage output lead wires 62*a*,62*b* as shown in FIG. 14, and holds on a side wall thereof a single screen voltage output lead wire 63 as depicted in FIG. 16.

The focusing voltage output lead wires 62*a*,62*b* are formed of conductors 64*a*,64*b* and coverings 65*a*,65*b* applied over outer peripheries of the conductors. As is illustrated in FIG. 14, two holding grooves 66 are arranged in parallel with each other so that the coverings 65*a*,65*b* are inserted therein. On opposite side walls of each holding groove 66, plural ribs 67 are formed in an opposing or offset relationship so that the plural ribs 67 extend in a direction perpendicular to the direction of the length of the corresponding covering 65*a* or 65*b*. The ribs 67 bite into the coverings 65*a*,65*b*, whereby the coverings 65*a*,65*b* are held in place.

On a center line of each holding groove 66, pinch ribs 68 and a cylindrical holder portion 69 are arranged at positions corresponding to the core 64*a* or 64*b*. As is shown in FIG. 18, two pinch ribs are arranged in parallel with each other, and a slit 71 is formed in a central part of the cylindrical holder portion 69 so that the slit 71 extends in an axial direction of the cylindrical holder portion 68 and opens toward the pinch ribs 68. A fitted groove 70 is formed extending from basal portions of the two pinch ribs 68 to a basal portion of the slit 71 (see FIGS. 17 and 18). The interval $W_1$ between the pinch ribs 68, the width $W_2$ of the slit 71 and the width $W_3$ of the fitted groove 70 are all set slightly narrower than the diameter $D_1$ of the conductor 64 ($W_1=W_2=W_3<D_1$).

Figure 17:
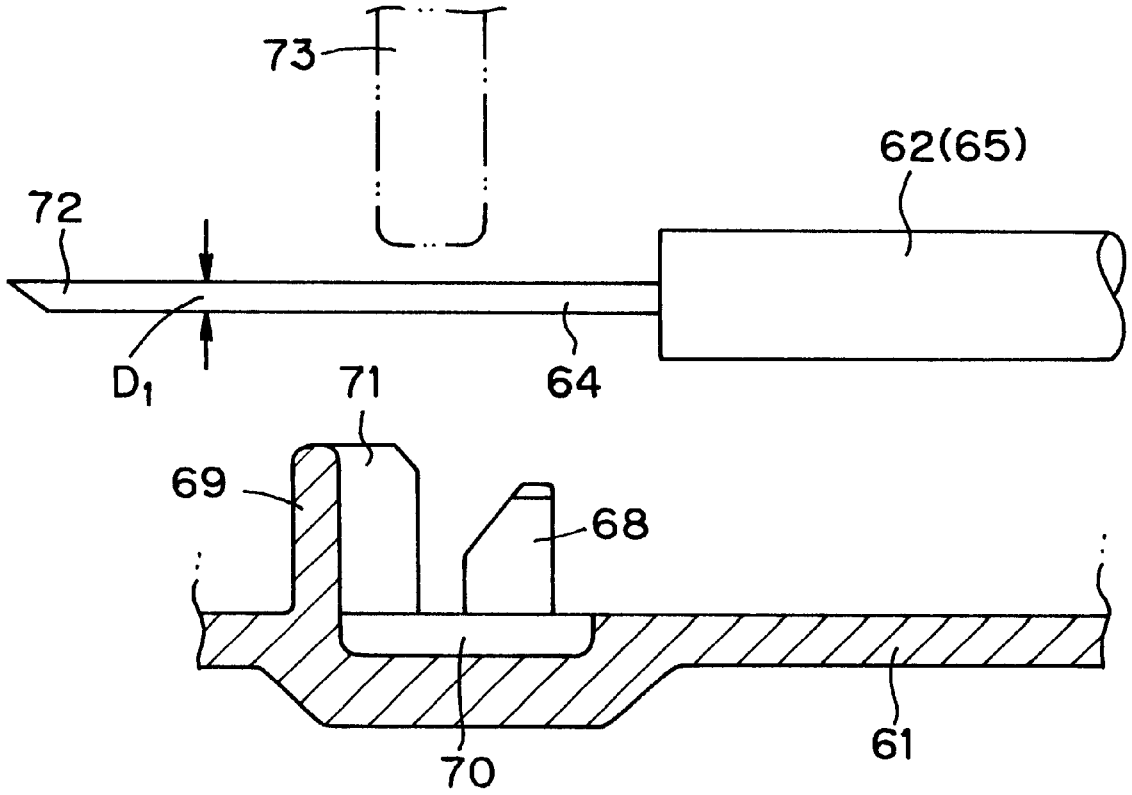
FIG. 17 is an enlarged fragmentary cross-sectional view of the lead wire holder casing before holding a focusing voltage output lead wire thereon.
Figure 18:
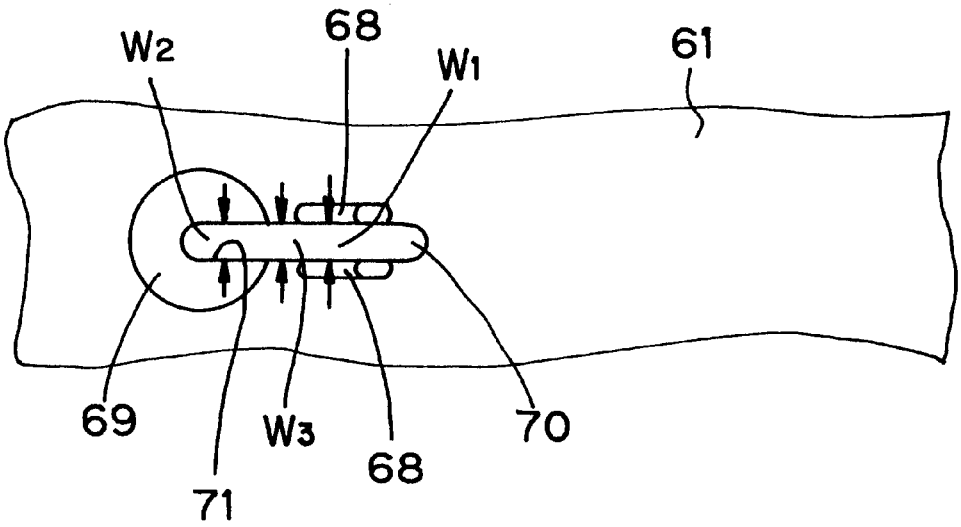
FIG. 18 is an enlarged fragmentary plan view showing pinch ribs, a cylindrical holder portion and a fitted groove before the focusing voltage output lead wire is held on the lead wire holder casing.
Figure 19:
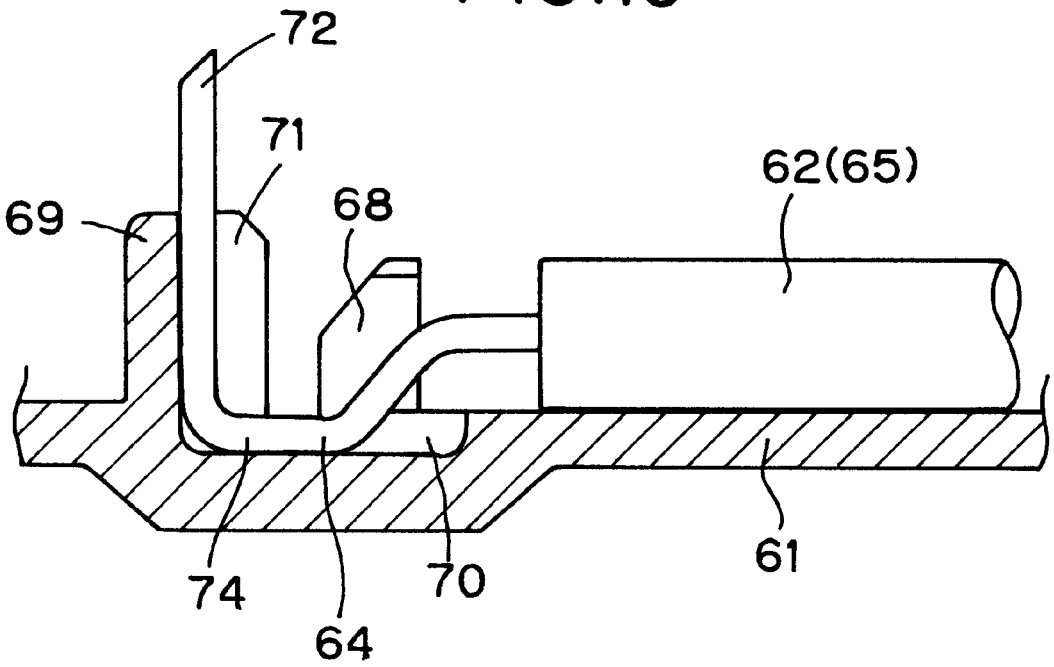
FIG. 19 is an enlarged fragmentary cross-sectional view illustrating the state of the focusing voltage output lead wire held on the lead wire holder casing.
Figure 20:
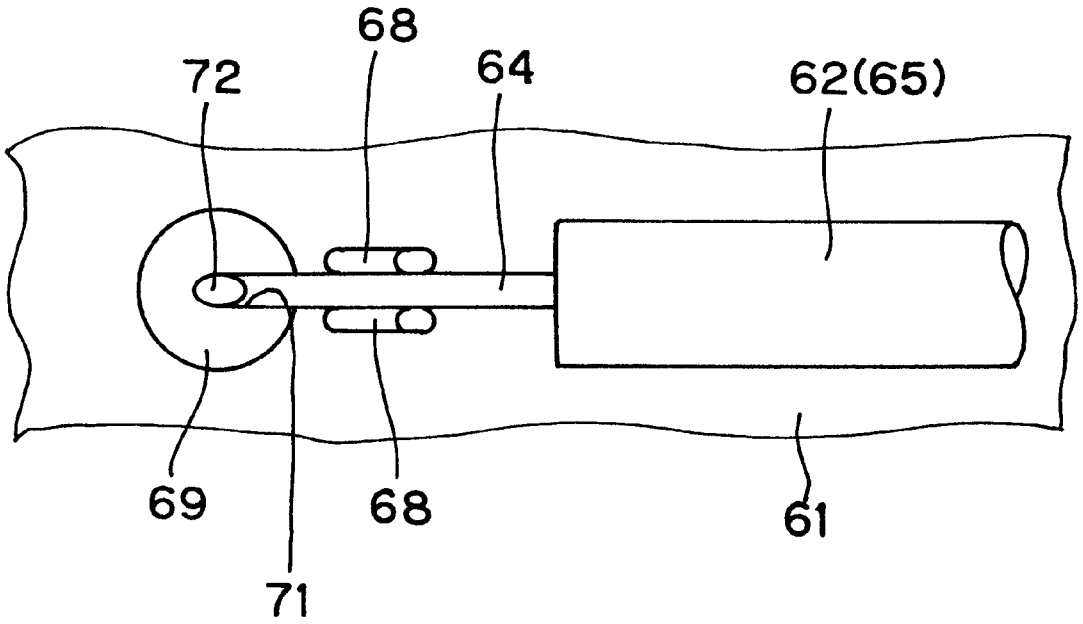
FIG. 20 is an enlarged fragmentary plan view showing the state of the focusing voltage output lead wire held on the lead wire holder casing.

As is depicted in FIG. 17, each conductor 64 is obliquely cut at a free end thereof so that a pointed portion 72 is formed. Upon mounting the focusing voltage output lead wire 62 on the lead wire holder casing 61, the conductor 62 which extends straight is placed extending over the pinch ribs 68 and the cylindrical holder portion 69 and a portion of the conductor 64 is forcedly fitted in the fitted groove 70 by an elongated jig 73. Because of the relationship of $W_1=W_2=W_3<D_1$, the conductor 64 is bent by the elongated jig 73 into an approximately L-shape at the basal portion of the cylindrical holder portion 69. Further, the pinch ribs 68, slit 71 and fitted groove 70 are resiliently widened somewhat so that an L-shaped bent portion 74 of the conductor 64 is firmly fixed by their resilience (see FIG. 19). Specifically, the pinch ribs 68 have a function to prevent loosening of the conductor 64, and the cylindrical holder portion 69 has a function to vertically hold the pointing end portion 72 of the conductor 64. To smoothly perform the force fitting of the conductor 64, tilted guide surfaces are formed on top parts of the pinch ribs 68 and cylindrical holder portion 69.

Figure 21:
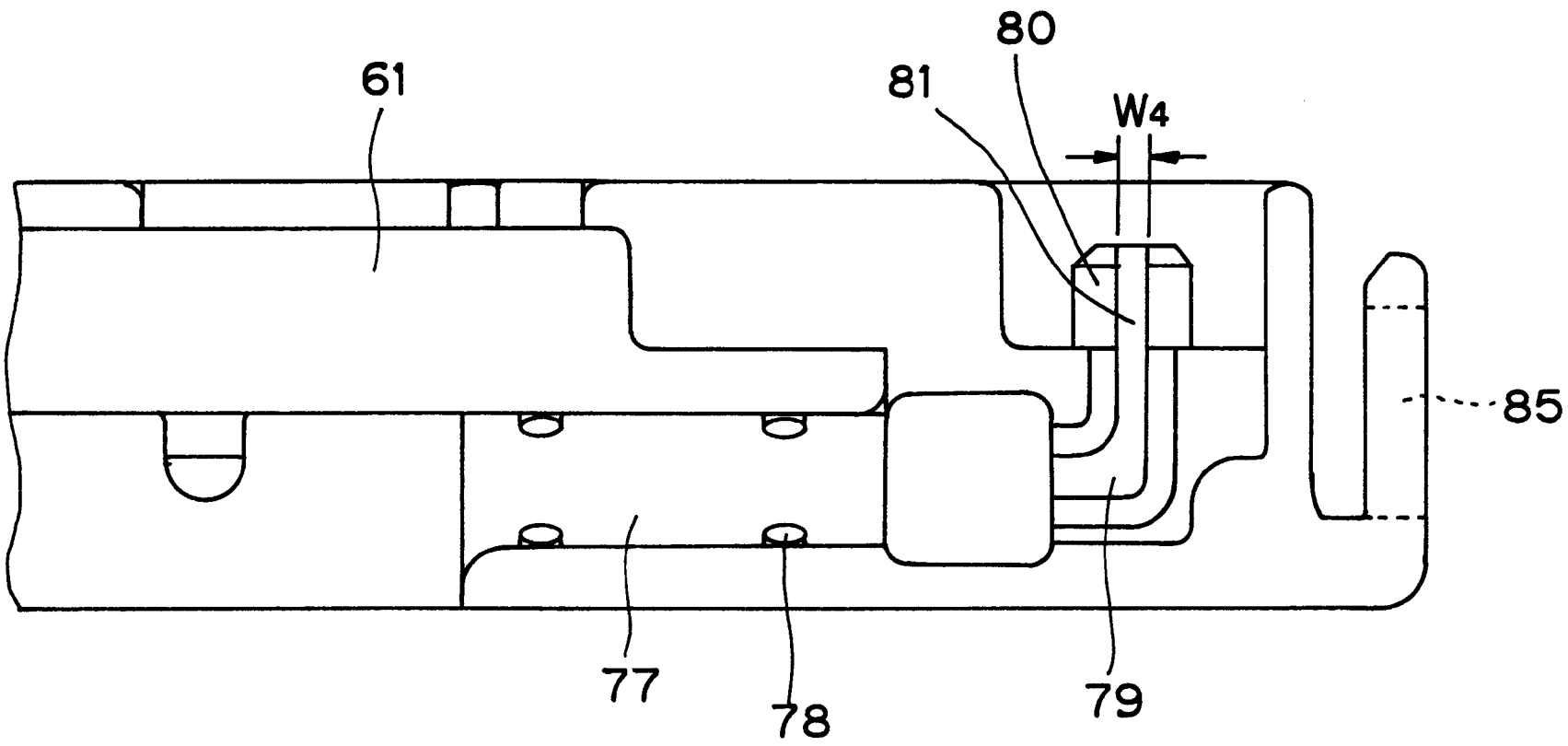
FIG. 21 is an enlarged fragmentary side view illustrating the state of the lead wire holder casing before a screen voltage output lead wire is held thereon.

As is illustrated in FIG. 16, the screen voltage output lead wire 63 is composed of a conductor 75 and a covering 76 applied over an outer periphery thereof. As is shown in FIG. 21, a holding groove 77 in which the covering 76 is to be inserted is formed on the side wall of the lead wire holder casing 61. On opposite side walls of the holding groove 77, plural ribs 78 are formed in an opposing or offset relationship so that the plural ribs 78 extend in a direction perpendicular to the length of the covering 76. The individual ribs 78 bite into the covering 76, whereby the covering 76 is held in place.

As is shown in FIG. 21, an L-shaped groove portion 79 is formed on the center line of the holding groove 77 at a position opposing the conductor 75. A cylindrical holder portion 80 is arranged at an upper part of the L-shaped groove portion 79. A slit 81 is formed in a central part of the cylindrical holder portion 80 so that the slit 81 extends in an axial direction of the cylindrical holder portion 80 and communicates with the L-shaped groove portion 79. The width $W_4$ of the slit 81 is set somewhat narrower than the diameter $D_2$ of the conductor 75 (see FIG. 22) ($W_4<D_2$).

Figure 22:
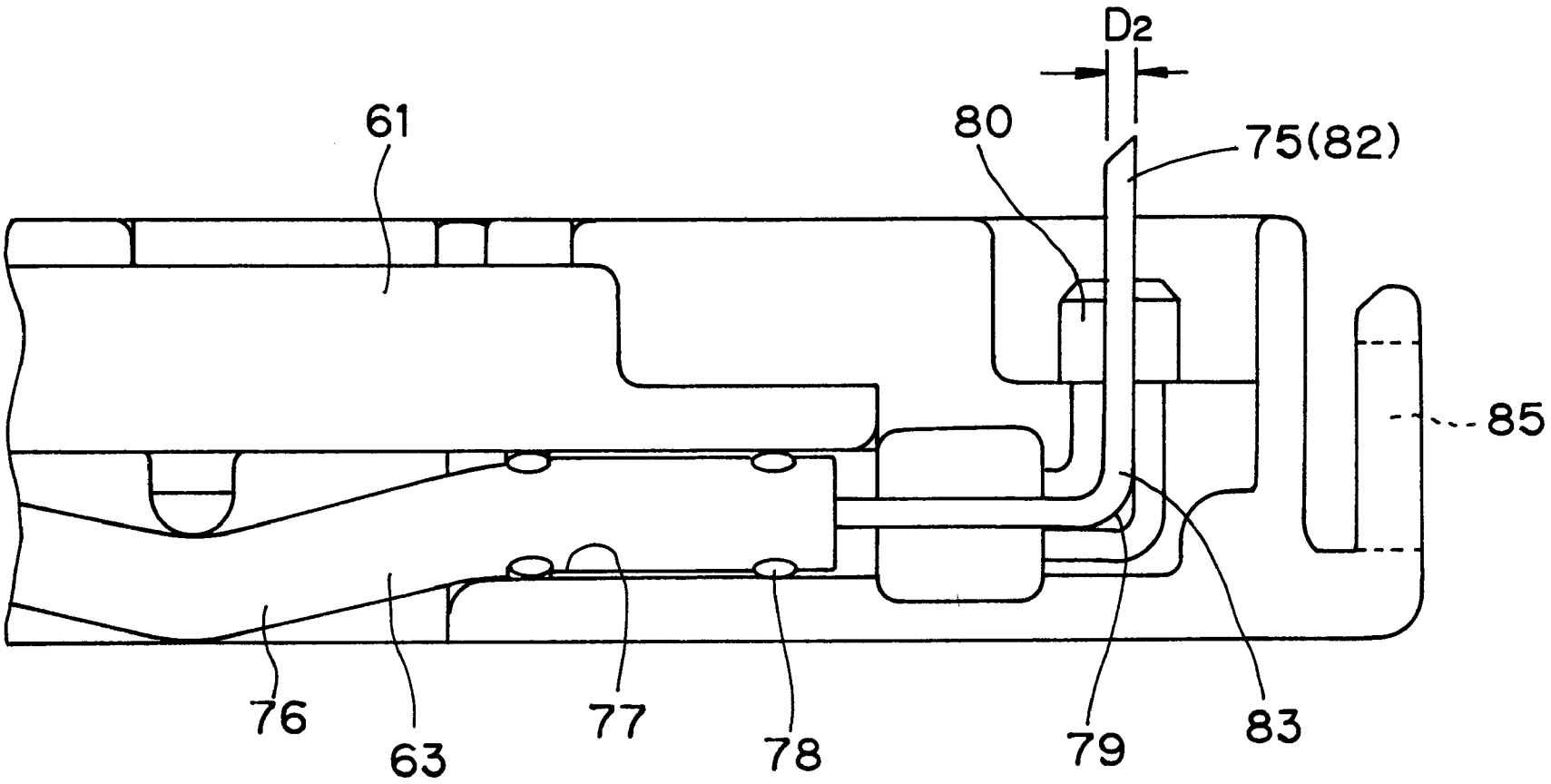
FIG. 22 is an enlarged fragmentary side view showing the state of the lead wire holder casing with the screen voltage output lead wire held thereon.

As is shown in FIG. 22, the conductor 75 is obliquely cut at a free end portion thereof so that a pointed end portion 82 is formed. Before mounting the screen voltage output lead wire 63 on the lead wire holder casing 61, the conductor 75 is bent in an L-shape beforehand to form an L-shaped bent portion 83. The L-shaped bent portion 83 is forcedly fitted in the L-shaped groove portion 79 and the slit 81 of the cylindrical holder portion 80 so that the pointed end portion 82 somewhat extends out from the cylindrical holder portion 80. Because of the relationship of $W_4<D_2$, the slit 81 is somewhat widened resiliently by the force fitting and the L-shaped bent portion 83 of the conductor 75 is firmly held in place by its resilience. The cylindrical holder portion has a function to vertically hold the pointed end portion 82 of the conductor 75.

Figure 23:
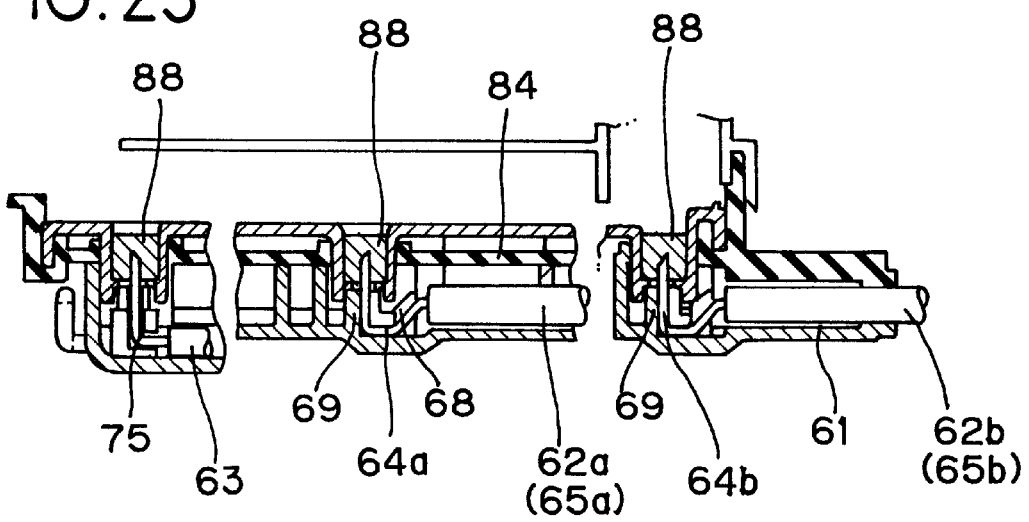
FIG. 23 is a fragmentary cross-sectional view showing the state of the lead wire holder casing with the focusing pack casing mounted thereon.
Figure 24:
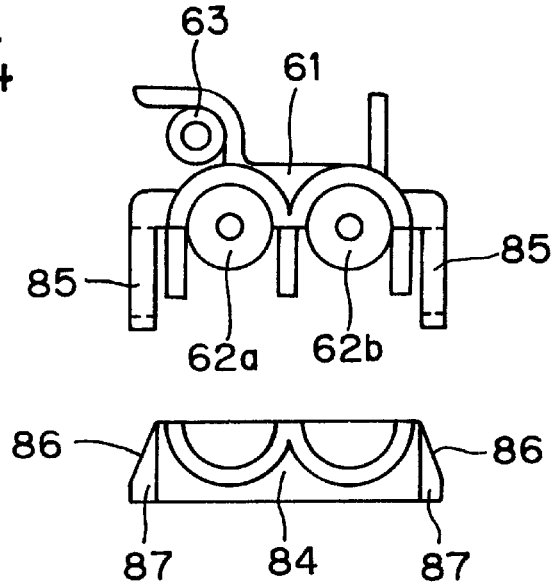
FIG. 24 is a fragmentary front view showing the state of the lead wire holder casing before the focusing pack casing is mounted thereon.
Figure 25:
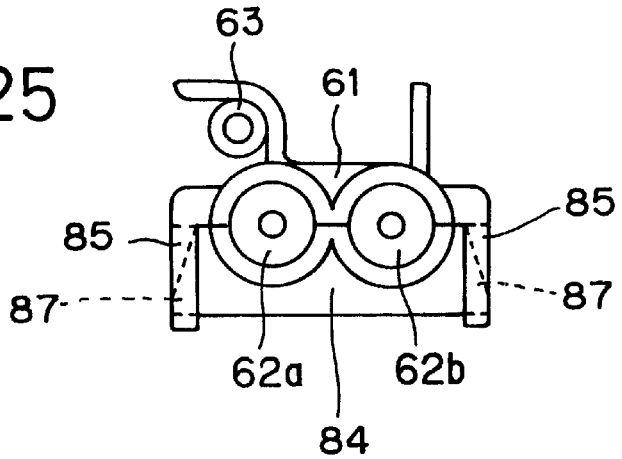
FIG. 25 is a fragmentary front view illustrating the state of the lead wire holder casing with the focusing pack casing mounted thereon.

As is depicted in FIG. 16, loops 85 which are in a rectangular form as seen in side view are arranged at plural positions (three positions in this embodiment) on an outer periphery of the lead wire holder casing 61 so that the loops 85 extend out from an outer periphery of the lead wire holder casing 61. A focusing pack casing 84 on which the lead wire holder casing 61 is to be mounted is provided with hooks 87 formed at positions corresponding to the respective loops 85 and having bevels 86 as shown in FIG. 24. Further, as is illustrated in FIG. 23, conductive rubbers 88 are arranged at positions corresponding to the conductors 64*a*,64*b*,75 on the focusing pack casing 84. Although not shown in this figure, the individual conductive rubbers 88 are connected to electrodes 6,6',6" at an output part of the flyback transformer 1 (see FIG. 10).

As is illustrated in FIG. 24, when the lead wire holder casing 61 with the focusing voltage output lead wires 62*a*,62*b* and the screen voltage output lead wire 63 accommodated and held therein is put on the focusing pack casing 84, a lower end portion of each loop 85 is bent somewhat outwardly while riding on the bevel 86 of the corresponding hook 87. As is shown in FIG. 23, when the lead wire holder casing 61 is pushed further downwardly, the pointed end portions 72,72,82 of the respective conductors 64*a*,64*b*,75 are inserted into the corresponding conductive rubbers 88 and at the same time and the hooks 87 are caused to fit in hollow portions of the corresponding loops 85, so that lower ends of the respective hooks 87 are brought into engagement with the corresponding loops 85. Accordingly, the lead wire holder casing 61 is firmly fixed on the focusing pack casing 84 so that the insertion of the individual conductors 64*a*, 64*b*,75 in the corresponding conductive rubbers 88 is surely maintained.

This application claims the priority of Japanese Patent Application No. HEI 9-343235 filed Dec. 12, 1997, which is incorporated herein by reference.

We claim:

1. A flyback transformer provided with a main body casing of said flyback transformer and a focusing pack casing, said main body casing accommodating therein predetermined electronic parts including a high-voltage coil, said focusing pack casing supporting thereon a rotatable knob for a variable resistor and accommodating therein predetermined electronic parts including a ceramic resistor, and said main body casing and said focusing pack casing being combined together so that said main body casing and said focusing pack casing oppose each other on sides of openings thereof, wherein:

an insulating cover is interposed between said main body casing and said focusing pack casing;

a through-hole is formed through said ceramic resistor, which is accommodated in said focusing pack casing, in association with a part of said ceramic resistor where said variable resistor is printed, and a fixing hole is formed through said insulating cover in a coaxial relationship with said through-hole; and one of two tongues of a slider which is fixed on said rotatable knob for said variable resistor is maintained in contact under pressure with said variable resistor of said ceramic resistor, and the other tongue of said slider is arranged coaxially with said fixing hole and is maintained in contact under pressure with a wire-shaped output terminal for focusing or screen voltages, said terminal being press-fitted in said fixing hole.

2. A flyback transformer according to claim 1, wherein said flyback transformer has a structure so that external force applied in an axial direction of said rotatable knob for said variable resistor is borne at a peripheral portion of said fixing hole in said insulating cover.

3. A flyback transformer according to claim 2, wherein said insulating cover has a fixing cylindrical portion of a large thickness as said peripheral portion of said fixing hole.

4. A flyback transformer according to claim 1, wherein said rotatable knob for said variable resistor is provided, on a side thereof where said slider is fixed, with a wall so that a basal portion of said slider is surrounded by said wall and a free end of said wall extends in said through-hole of said ceramic resistor.

5. A flyback transformer according to claim 1, wherein said rotatable knob for said variable resistor is provided, on a side thereof where said slider is fixed, with a recess which permits flexion of the other tongue of said tongue.

6. A flyback transformer according to claim 1, wherein the other tongue of said slider is maintained in contact under pressure with a tip portion of said wire-shaped output terminal.

7. A flyback transformer according to claim 1, wherein the other tongue of said slider is maintained in contact under pressure with a peripheral surface of said wire-shaped output terminal.

8. A flyback transformer according to claim 7, wherein the other tongue of said slider defines a recess in which an outer peripheral portion of said wire-shaped output terminal is partly fitted.

9. A flyback transformer according to claim 1, wherein said slider is provided at a basal portion thereof with plural engaging lugs extending out from said basal portion, and each of said engaging lugs is in engagement with a portion of said rotatable knob for said variable resistor.

10. A flyback transformer comprising:

a cylindrical holder portion made of a molded body of a synthetic resin and defining a slit extending in an axial direction of said cylindrical holder portion, a voltage output lead wire composed of a covering and a conductor, said conductor being exposed at a portion thereof without said covering, said exposed portion of said conductor being formed in an L-shaped bent portion which is press-fitted in said cylindrical holder portion, whereby said L-shaped bent portion being resiliently held at a basal portion thereof by said cylindrical holder portion, and a conductive rubber connected to an output part;

wherein a free end portion of said conductor extends out from said cylindrical holder portion and is inserted in said conductive rubber.

11. A flyback transformer according to claim 10, wherein a pinch rib is arranged in the vicinity of said cylindrical holder portion to prevent loosening of said conductor, and a portion of said conductor is resiliently held by said pinch rib.

12. A flyback transformer according to claim 11, wherein a fitted groove is formed extending from a basal portion of said pinch rib to a basal portion of said cylindrical holder portion, whereby another portion of said conductor is resiliently fitted in said fitted groove.

13. A flyback transformer according to claim 10, wherein said cylindrical holder portion defines at a lower end portion thereof an L-shaped groove portion in communication with said slit, and said L-shaped bent portion of said conductor is press-fitted in said L-shaped groove portion and also in said slit of said cylindrical holder portion.

14. A flyback transformer according to claim 10, wherein said cylindrical holder portion is arranged on a lead wire holder casing, an engaging device is formed on one of said lead wire holder casing and a focusing pack casing to which said lead wire holder case is to be attached, an engaged device is formed on the other one of said lead wire holder casing and said focusing pack casing, and based on engagement between said engaging portion and said engaged portion, said conductor is maintained inserted in said conductive rubber.

* * * * *